US010900674B2

(12) United States Patent
Hur et al.

(10) Patent No.: US 10,900,674 B2
(45) Date of Patent: Jan. 26, 2021

(54) AIR CONDITIONING APPARATUS, CENTRAL CONTROL APPARATUS OF THE AIR CONDITIONING APPARATUS, REMOTE CONTROL APPARATUS OF THE AIR CONDITIONING APPARATUS, INDOOR APPARATUS OF THE AIR CONDITIONING APPARATUS AND METHOD OF CONTROLLING THEREOF

(71) Applicant: Samsung Electronics Co., Ltd., Suwon-si (KR)

(72) Inventors: Jae Hun Hur, Yongin-si (KR); Chang-Yong Lee, Suwon-si (KR); Min Gyu Kim, Seongnam-si (KR); Yun-Nam Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/843,969

(22) Filed: Dec. 15, 2017

(65) Prior Publication Data

US 2018/0172289 A1 Jun. 21, 2018

(30) Foreign Application Priority Data

Dec. 21, 2016 (KR) ..... 10-2016-0175989

(51) Int. Cl.
*F24F 3/06* (2006.01)
*F24F 11/56* (2018.01)
*F24F 11/52* (2018.01)

(52) U.S. Cl.
CPC ..... *F24F 3/06* (2013.01); *F24F 11/52* (2018.01); *F24F 11/56* (2018.01)

(58) Field of Classification Search
None
See application file for complete search history.

(56) References Cited

U.S. PATENT DOCUMENTS 5,603,225 A * 2/1997 Tobi ..... F24F 3/065 62/175
5,630,324 A * 5/1997 Yoshida ..... F24F 3/065 62/175

FOREIGN PATENT DOCUMENTS

CN 1121573 A 5/1996
CN 1477345 A 2/2004
(Continued)

OTHER PUBLICATIONS

International Search Report dated Apr. 10, 2018 in connection with International Patent Application No. PCT/KR2017/015078.
(Continued)

*Primary Examiner* — Carlos R Ortiz Rodriguez

(57) ABSTRACT

Provided is an air conditioning apparatus, a central control apparatus of the air conditioning apparatus, a remote control apparatus of the air conditioning apparatus, an indoor apparatus of the air conditioning apparatus and a method of controlling thereof. The central control apparatus of the air conditioning apparatus includes: a plurality of branched ports connected to a pipe of a plurality of indoor apparatuses and provided with predetermined identification information; and a central controller configured to identify the plurality of indoor apparatuses connected through the branched port, based on the identification information, and configured to control an operation of components contained in the air conditioning apparatus based on a result of the identification.

5 Claims, 17 Drawing Sheets

(56) References Cited

FOREIGN PATENT DOCUMENTS

| | | | |
|---|---|---|---|
| CN | 1782584 | A | 6/2006 |
| CN | 103807975 | A | 5/2014 |
| JP | H11-118275 | A | 4/1999 |
| JP | 2006-207949 | A | 8/2006 |
| JP | 3829340 | B2 | 10/2006 |
| JP | 2015-227734 | A | 12/2015 |
| KR | 10-0504888 | B1 | 7/2005 |
| KR | 10-2008-0060761 | A | 7/2008 |
| KR | 10-2008-0060766 | A | 7/2008 |
| KR | 10-1035384 | B1 | 5/2011 |
| KR | 10-2011-0101371 | A | 9/2011 |

OTHER PUBLICATIONS

The First Office Action dated Sep. 14, 2020 in connection with Chinese Application No. 201780080385.9, 19 pages.

* cited by examiner

AIR CONDITIONING APPARATUS, CENTRAL CONTROL APPARATUS OF THE AIR CONDITIONING APPARATUS, REMOTE CONTROL APPARATUS OF THE AIR CONDITIONING APPARATUS, INDOOR APPARATUS OF THE AIR CONDITIONING APPARATUS AND METHOD OF CONTROLLING THEREOF

CROSS-REFERENCE TO RELATED APPLICATIONS AND CLAIM OF PRIORITY

This application is related to and claims priority to Korean Patent Application No. 10-2016-0175989, filed on Dec. 21, 2016, the contents of which are incorporated herein by reference.

TECHNICAL FIELD

Embodiments of the present disclosure relate to an air conditioning apparatus capable of effectively controlling a plurality of indoor apparatus connected to a branched port, a central control apparatus of the air conditioning apparatus, a remote control apparatus of the air conditioning apparatus, an indoor apparatus of the air conditioning apparatus and a method of controlling thereof.

BACKGROUND

A multi type air conditioning apparatus well-known as a system air conditioner may include one or more outdoor apparatuses and two or more indoor apparatuses, and the multi type air conditioning apparatus is configured to perform air conditioning on at least one floor of a building or the entire building, according to a central control manner.

The multi type air conditioning apparatus may be provided with each remote control apparatus for corresponding one of the plurality of indoor apparatuses so as to receive a control command related to the plurality of indoor apparatuses. In addition, the multi type air conditioning apparatus may typically include at least one remote control apparatus configured to overall manage the plurality of indoor apparatuses. For example, as for a multi type air conditioning apparatus in which five indoor apparatuses are installed in each floor of a building having ten floors, each remote control apparatus may be installed in corresponding one floor so that it is possible to simultaneously receive a control command about five indoor apparatuses installed in each floor.

As the number of the indoor apparatuses is increased, the number of branched ports provided in a central control apparatus may be increased and thus the manufacturing cost may be increased. Accordingly, studies have been conducted to reduce the number of the branched port and simultaneously to control effectively the plurality of indoor apparatuses connected to the branched port.

SUMMARY

To address the above-discussed deficiencies, it is a primary object to provide an air conditioning apparatus having an improved convenience and safety, a central control apparatus of the air conditioning apparatus, a remote control apparatus of the air conditioning apparatus, an indoor apparatus of the air conditioning apparatus and a method of controlling thereof.

Additional aspects of the present disclosure will be set forth in part in the description which follows and, in part, will be obvious from the description, or may be learned by practice of the present disclosure.

In accordance with one aspect of the present disclosure, a central control apparatus of an air conditioning apparatus comprising: a plurality of branched ports connected to a pipe of a plurality of indoor apparatuses and provided with predetermined identification information; and a central controller configured to identify the plurality of indoor apparatuses connected through the branched port, based on the identification information, and configured to control an operation of components contained in the air conditioning apparatus based on a result of the identification.

The central control apparatus of the air conditioning apparatus may further comprise a central communicator configured to receive matching information between the plurality of indoor apparatuses and the plurality of branched ports, which is set based on the identification information.

The central controller may identify an indoor apparatus connected to a corresponding one of the plurality of branched ports based on the received matching information.

The central controller may update an operation mode of each of the plurality of branched ports according to a predetermined period, based on state information of the indoor apparatus connected to each of the plurality of branched ports, and information about a predetermined operation mode of the branched port.

The central control apparatus of the air conditioning apparatus may comprise a central communicator configured to receive state information of an indoor apparatus connected to the plurality of branched ports.

The central controller may determine whether to stop an operation of at least one of components of the air conditioning apparatus by determining whether an error occurs and a level of the error based on the received state information of the indoor apparatus.

In accordance with one aspect of the present disclosure, an indoor apparatus of an air conditioning apparatus comprising: an indoor apparatus communicator configured to receive information about a dedicated mode and information about an operation mode of branched port; and an indoor apparatus controller configured to perform a mixing operation prevention process based on at least one of the received information about the dedicated mode and the received information about the operation mode of branched port.

The indoor apparatus controller may determine whether to validate a control command related to an operation mode based on at least one of the received information about the dedicated mode and the received information about the operation mode of branched port.

The indoor apparatus controller may select an operation mode by comparing the received information about the dedicated mode, the received information about the operation mode of branched port, and information about an operation mode of another indoor apparatus connected to the branched port when an automatic mode is received.

The indoor apparatus controller may select an operation mode based on the result of the comparison among the received information about the dedicated mode, the received information about the operation mode of branched port and the information about the operation mode of another indoor apparatus connected to the branched port, and information about a temperature of the indoor detected by a temperature detector when an automatic mode is received.

The indoor apparatus controller may determine whether a mixing operation is performed or not by comparing the received information about the dedicated mode, the received information about the operation mode of branched port, and the operation mode of the indoor apparatus according to a predetermined period.

The indoor apparatus controller may control a component of the indoor apparatus so that the component is stopped when it is determined that the mixing operation is performed for equal to or longer than a predetermined period of time.

The indoor apparatus controller may display a user interface configured to indicate a plurality of icons about an execution command of an operation mode by applying the received information about the dedicated mode and the received information about the operation mode of branched port, on an indoor apparatus display.

The indoor apparatus controller may determine whether to validate an execution command of an operation mode received via an indoor apparatus operator, based on the received information about the dedicated mode and the received information about the operation mode of branched port.

In accordance with one aspect of the present disclosure, a remote control apparatus of an air conditioning apparatus comprising: a remote display; and a remote controller configured to display a user interface configured to receive a control command for each group based on at least one of matching information between a branched port of a central control apparatus and an indoor apparatus, and information about a predetermined operation of each of branched ports, on the remote display.

The remote controller may generate at least one group based on the matching information between the branched port of the central control apparatus and the indoor apparatus.

The remote controller may display a user interface configured to set the matching information between the branched port of the central control apparatus and the indoor apparatus, on the remote display.

The remote controller may determine whether to validate a control command related to an operation mode received via a remote operator, based on the information about the predetermined operation of each of branched ports.

The remote controller may display a user interface configured to indicate a plurality of icons about an execution command of an operation mode by applying the information about the operation of each of branched ports, on the remote display.

The remote controller may display a user interface configured to change a display method of the plurality of icons about the execution command of the operation mode by applying a result of updating the predetermined operation of each of branched ports, on an indoor apparatus display.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Figure 1:
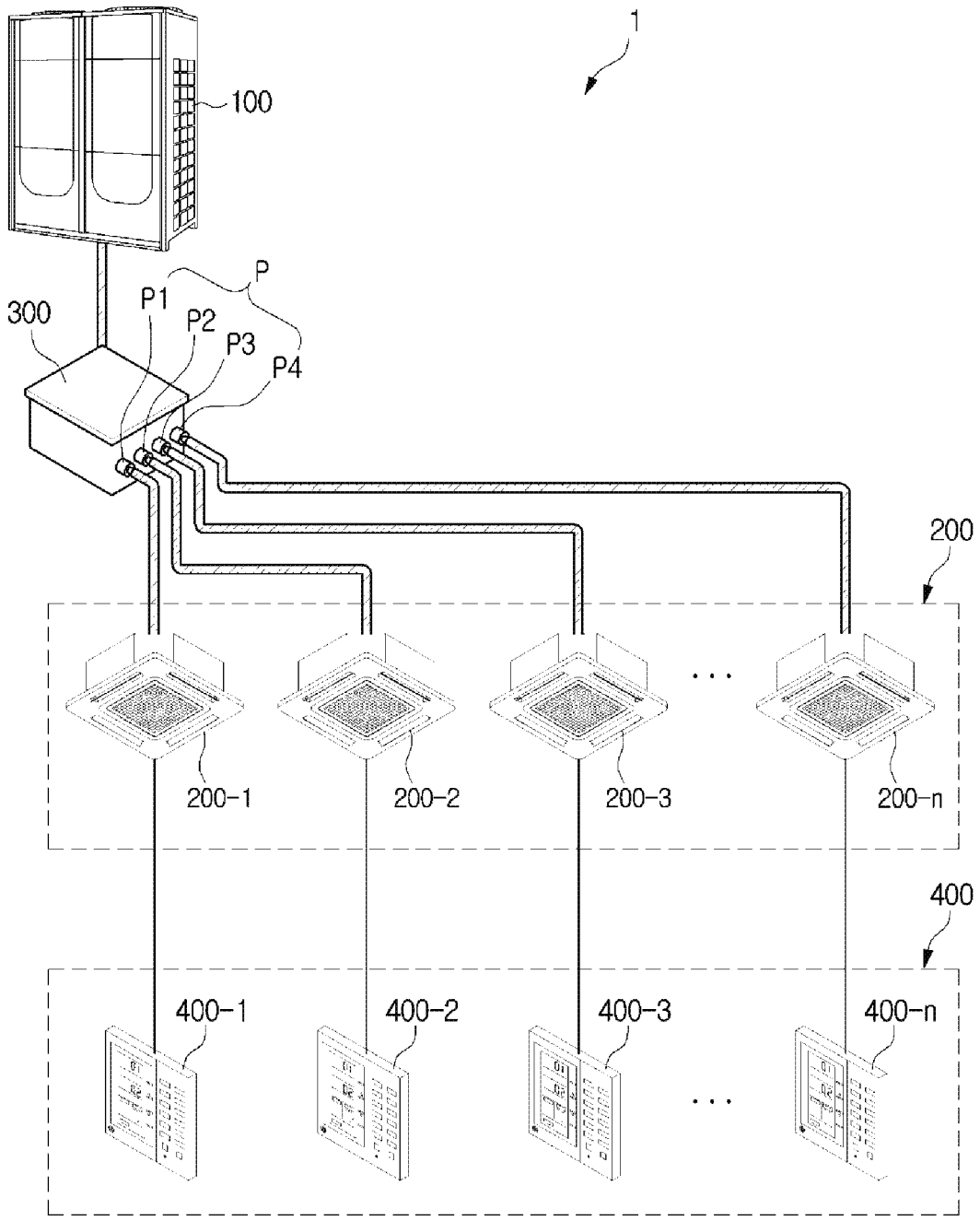
FIGS. 1 and 2 illustrate views of a configuration of an air conditioning apparatus in accordance with various embodiments of the present disclosure.
Figure 2:
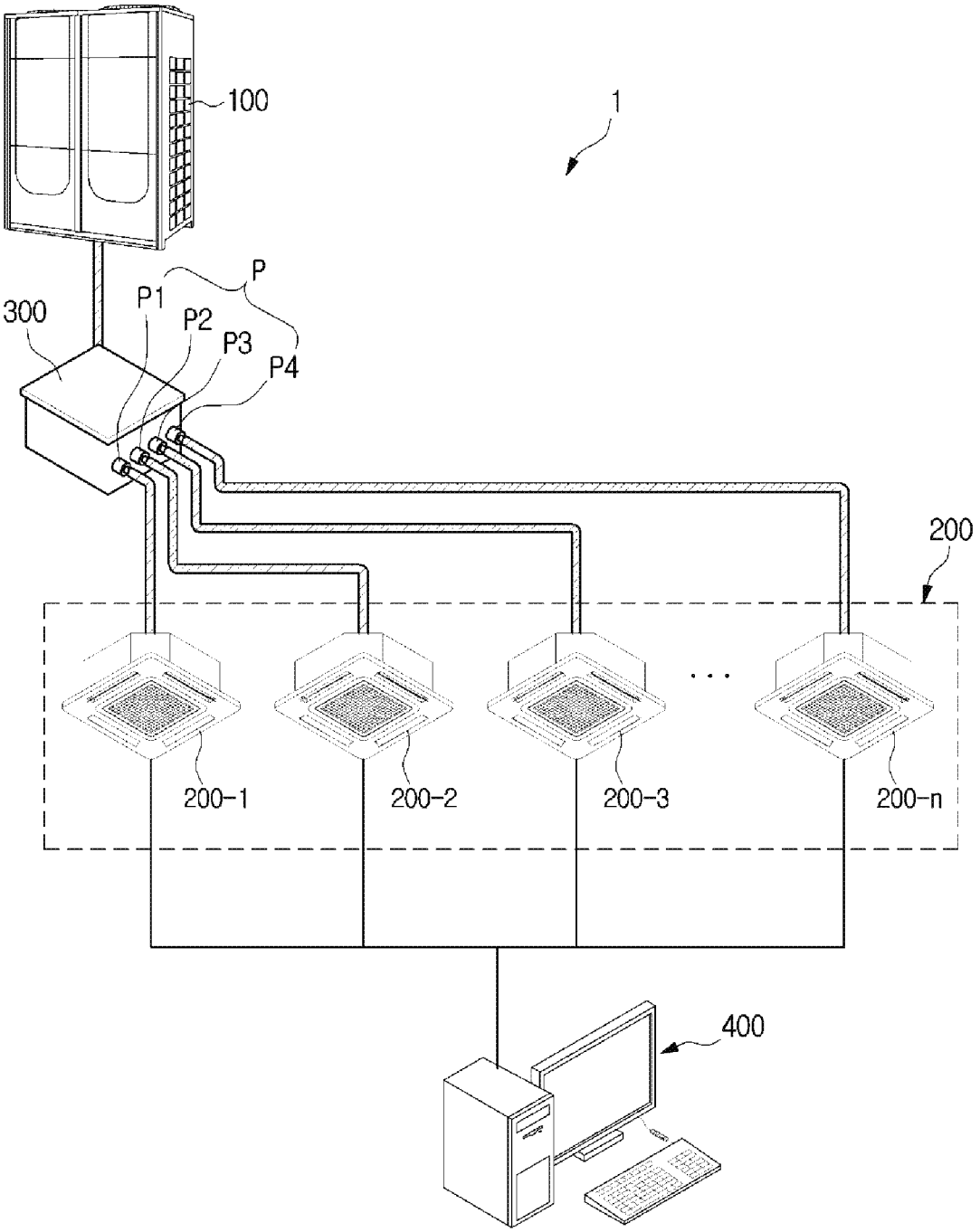
Figure 3:
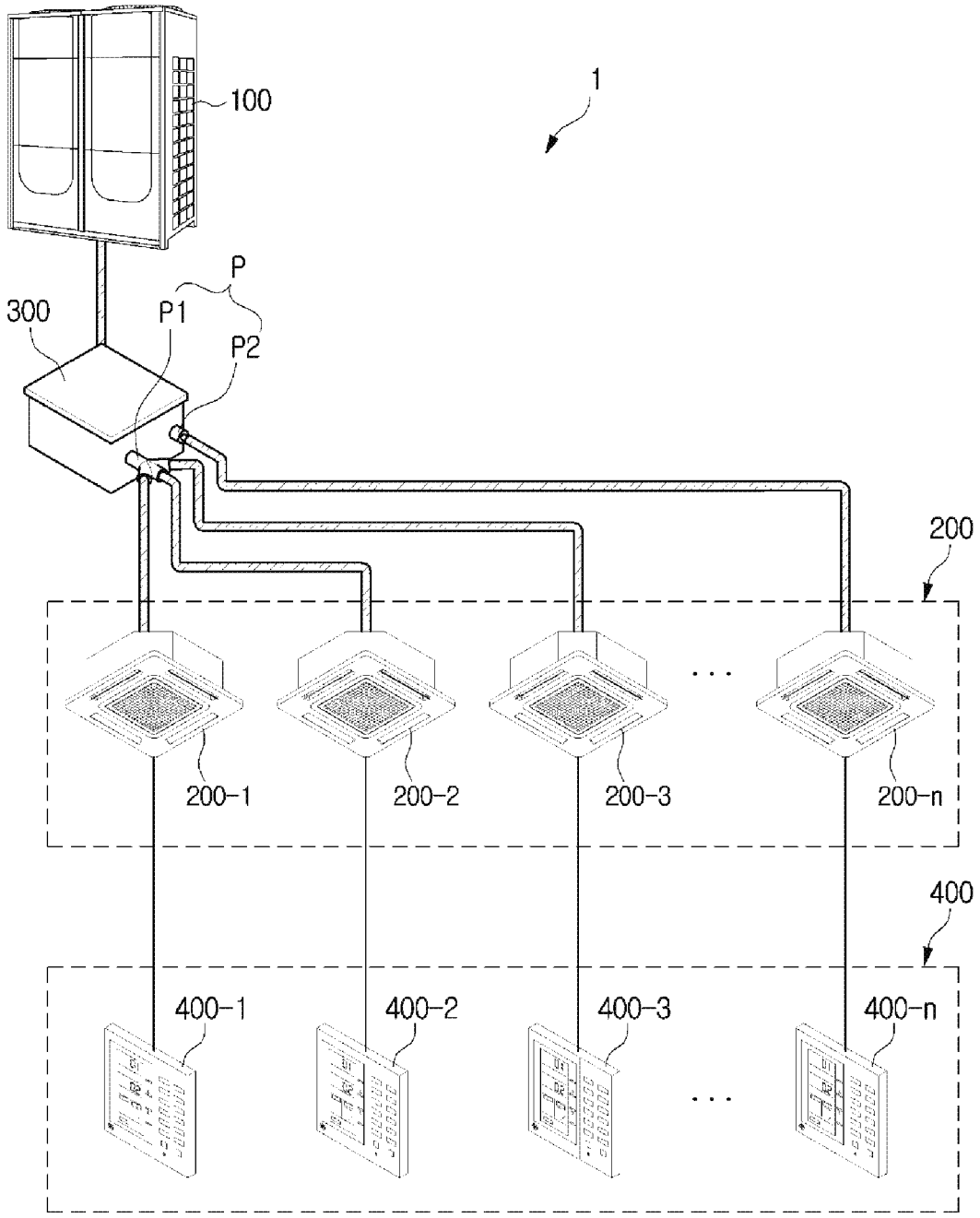
FIG. 3 illustrates a case in which a plurality of indoor apparatuses are connected to each other via a branched port of a central control apparatus of the air conditioning apparatus in accordance with various embodiments of the present disclosure.
Figure 4:
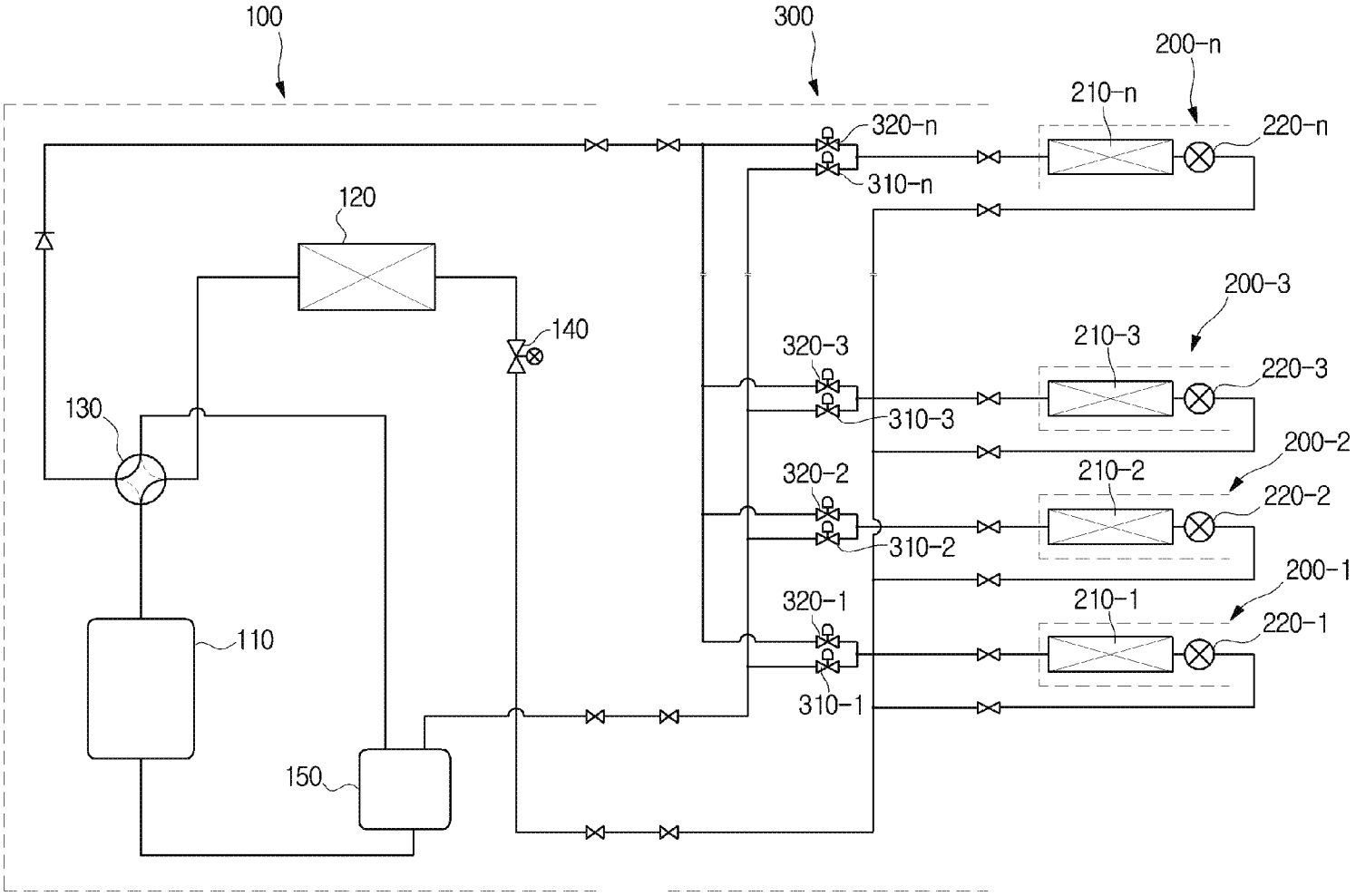
FIG. 4 illustrates a flow of refrigerant in the air conditioning apparatus in accordance with an embodiment.

FIGS. 1 and 2 illustrate views of a configuration of an air conditioning apparatus in accordance with different embodiments, and FIG. 3 illustrates a view of a case in which a plurality of indoor apparatuses are connected to each other via a branched port of a central control apparatus of the air conditioning apparatus in accordance with an embodiment. FIG. 4 is a view schematically illustrating a flow of refrigerant in the air conditioning apparatus in accordance with an embodiment. Hereinafter a description thereof will be described together to avoid a duplicate description.

Referring to FIG. 1, the air conditioning apparatus 1 may include an outdoor apparatus 100 provided in the outdoor to perform heat exchange between the outdoor air and refrigerant, a plurality of indoor apparatuses 200: 200-1, 200-2, 200-3, . . . , **200-*n* provided in the indoor to perform heat exchange between the indoor air and refrigerant, a central control apparatus 300 configured to distribute the refrigerant, which is supplied from the outdoor apparatus 100, to the plurality of indoor apparatuses 200 to sensibly perform cooling or heating, and a remote control apparatus 400 configured to receive a control command related to the plurality of indoor apparatuses 200, from a user. Between the outdoor apparatus 100 and the plurality of indoor apparatuses 200, and between the outdoor apparatuses 100** may be connected through a pipe.

The remote control apparatus 400 described later may include an input device configured to receive a variety of control commands from a user and a processing unit configured to remotely control at least one component of the air conditioning apparatus 1 in response to the received control command. For example, the remote control apparatus 400 may include at least one of a button-type switch, a membrane switch, and a display panel implemented by a touch screen type as the input device, and a processor such as a Micro Control Unit (MCU) as the processing unit.

For example, the remote control apparatus 400 may correspond to a remote controller connected to any one of the plurality of indoor apparatuses 200 via a wired/wireless communication network. A plurality of the remote controllers may be provided to control each of the plurality of indoor apparatuses 200. According to embodiments, a plurality of remote controllers 400: 400-1, 400-2, 400-3, **400-*n* may be implemented as illustrated in FIG. 1, and thus each remote controller may be mounted to one surface of an indoor space in which a corresponding one of the plurality of indoor apparatuses 200 is provided. The plurality of remote controllers 400: 400-1, 400-2, 400-3, 400-*n*** may be implemented in a hand-held type, but is not limited thereto.

Alternatively, the remote control apparatus 400 may be a user terminal. The user terminal may include any kind of electronics which is portable and has a built-in battery to allow to be operated without being connected to an external power source. For example, the user terminal may include a smartphone, or a wearable device in the form of glasses and a clock, but is not limited thereto.

As another example, as illustrated in FIG. 2, the remote control apparatus 400 may be a device configured to integrally manage the plurality of indoor apparatuses 200. According an embodiment, the remote control apparatus 400 may be a device provided with a web server to allow a manager to control and monitor the plurality of indoor apparatuses. The remote control apparatus 400 may control a peak power control of the plurality of indoor apparatuses 200 as well as the remote control apparatus 400 may display a user interface, which is configured to allow a user to easily control the operation information of the indoor apparatus, on a display. Particularly, the remote control apparatus 400 may correspond to an apparatus having a device in which a data management server is embedded, and a display.

Hereinafter, for convenience of description, the remote control apparatus 400 will be described as a shape of FIG. 2 in which a web server is embedded to allow a manager to control and monitor the plurality of indoor apparatuses 200, but embodiments described below is not limited thereto.

The central control apparatus 300 and the indoor apparatus 200 may be connected to each other via a branched port (P) and the pipe of the central control apparatus 300. A cooling valve 310 and a heating valve 320, which are configured to control the flow of the refrigerant according to an operation mode of the air conditioning apparatus 1, e.g., a cooling mode or a heating mode, may be provided in any one of the branched port (P) and the pipe. The branched port (P) may be called as "port", but hereinafter for convenience of description, it will be called as "branched port (P)".

According to the shape of the branched port (P), the branched port (P) may be connected to a pipe of at least one indoor apparatus 200. For example, a single branched port may be connected to a pipe of a single indoor apparatus. Particularly, as illustrated in FIGS. 1 and 2, a first branched port (P1) may be connected to a pipe of a first indoor apparatus 200-1, a second branched port (P2) may be connected to a pipe of a second indoor apparatus 200-2, and a third branched port (P3) may be connected to a pipe of a third indoor apparatus 200-3.

As another example, a single branched port may be connected to pipes of the plurality of indoor apparatuses. Referring to FIG. 3, the first branched port (P1) may be connected to the pipes of the first, second, and third indoor apparatus 200-1, 200-2, and 200-3. Alternatively, each pipe of two or less or four or more indoor apparatus may be connected to a single branched port, but is not limited thereto.

As the number of the indoor apparatus connected to a single branched port is increased, the number of the branched port provided in the central control apparatus 300 may be reduced. Accordingly, the manufacturing cost may be reduced. However, it may be that the central control apparatus 300 identifies each indoor apparatus connected to the branched port (P) and it may be that the indoor apparatus 200 identifies the branched port (P) connected to thereto.

According to embodiments, the air conditioning apparatus 1 may easily identify the central control apparatus 300 and the indoor apparatus 200 each other, and the air conditioning apparatus 1 may perform a mixing operation prevention process between the indoor apparatuses connected to the same branched port. According to embodiments, the air conditioning apparatus 1 may perform a group-control in the indoor apparatuses connected to the same branched port and thus it may be possible to improve the manager convenience. A detail description thereof will be described later.

Referring to FIG. 4, as mentioned above, the air conditioning apparatus 1 includes the outdoor apparatus 100, the indoor apparatus 200 and the central control apparatus 300. FIG. 4 illustrates a flow of refrigeration. Particularly, FIG. 4 illustrates that a pipe of a single indoor apparatus is connected to a single branched port for the convenience of description, but is not limited thereto. Therefore, a plurality of indoor apparatuses may be connected to a single branched port.

The central control apparatus 300 may correspond to a distributor and a mode change unit (MCU) configured to control the conversion between the cooling mode and the heating mode. Hereinafter for the convenience of description, it will be commonly called as the central control apparatus 300.

The outdoor apparatus 100 may include a compressor 110 configured to compress refrigerant, an outdoor heat exchanger 120 configured to perform heat exchange between the outdoor air and the refrigerant, a four-way valve 130 configured to selectively guide refrigerant discharged from the compressor 110, an outdoor expansion valve 140 configured to decompress refrigerant guided to the outdoor heat exchanger 120 when performing the heating, and an accumulator 150 configured to prevent liquid refrigerant from flowing into the compressor 110.

The indoor apparatus 200 may include an indoor heat exchanger 210: 210-1, 210-2, 210-3, . . . , **210-*n* configured to perform heat exchange between the indoor air and the refrigerant, and an indoor expansion valve 220: 220-1, 220-2, 220-3, . . . 220-*n* configured to decompress refrigerant supplied to the indoor heat exchanger 210** when performing the cooling.

The central control apparatus 300 includes a branched port provided between the outdoor apparatus 100 and the indoor apparatus 200 to guide the refrigerant, which is supplied from the outdoor apparatus 100, to the pipe of the indoor apparatus 200, and the cooling valve 310 and the heating valve 320, which are provided in the inside of the pipe and configured to control the flow of the refrigerant according to the operation mode of the air conditioning apparatus 1, e.g., the cooling mode or the heating mode.

As for the circulation of the refrigerant, when the air conditioning apparatus 1 is in the cooling mode, the refrigerant may be compressed to a high pressure by the compressor 110 of the outdoor apparatus 100, and the compressed refrigerant may be guided into the outdoor heat exchanger 120 by the four-way valve 130. The compressed refrigerant may be condensed in the outdoor heat exchanger 120, and the refrigerant may emit the latent heat to the outdoor air while being condensed. The condensed refrigerant may be guided to the indoor apparatus 200 through the central control apparatus 300.

The refrigerant directed to the indoor apparatus 200 may be compressed in the indoor expansion valve 220 provided in the indoor apparatus 200 and then evaporated in the indoor heat exchanger 210. While being evaporated, the refrigerant may absorb the latent heat from the indoor air. Therefore, when in the cooling mode, the air conditioning apparatus 1 may cool the indoor air through the heat exchange between the refrigerant and the indoor air, which is performed in the indoor heat exchanger 210.

The evaporated refrigerant may be guided to the outdoor apparatus 100 through the cooling valve 310 provided in the central control apparatus 300. In the accumulator 150, the refrigerant may be divided into liquid refrigerant, which is not evaporated, and gas refrigerant, which is evaporated, and then provided to the compressor 110. The refrigerant guided to the compressor 110 may be compressed and then supplied to the four-way valve 130 again, so that the above mentioned circulation of the refrigerant is repeated.

That is, in the case of cooling mode, the air conditioning apparatus 1 may emit the thermal energy of the indoor to the outdoor such that the indoor apparatus 200 absorbs the thermal energy of the indoor air and the outdoor apparatus 100 emits the thermal energy to the outdoor.

In the case of heating mode, the refrigerant may be compressed to a high pressure by the compressor 110 of the outdoor apparatus 100, and the compressed refrigerant may be guided into the central control apparatus 300 by the four-way valve 130. The compressed refrigerant may be guided to the indoor apparatus 200 via the heating valve 320 of the central control apparatus 300.

The refrigerant may be condensed in the indoor heat exchanger 210 provided in the indoor apparatus 200. When in the heating mode, the air conditioning apparatus 1 may heat the indoor air through the heat exchange between the refrigerant and the indoor air, which is performed in the indoor heat exchanger 210. The condensed refrigerant may be decompressed in the indoor expansion valve 220 and then guided to the outdoor apparatus 100 via the central control apparatus 300.

The refrigerant guided to the outdoor apparatus 100 may be decompressed in the outdoor expansion valve 140 provided in the outdoor apparatus 100 and then evaporated in the outdoor heat exchanger 120. In the accumulator 150, the evaporated refrigerant may be divided into liquid refrigerant, which is not evaporated, and gas refrigerant, which is evaporated, and then provided to the compressor 110. The refrigerant guided to the compressor 110 may be compressed and then supplied to the four-way valve 130 again, so that the above mentioned circulation of the refrigerant is repeated.

That is, in the case of heating mode, the air conditioning apparatus 1 may transmit the thermal energy of the outdoor to the indoor such that the outdoor apparatus 100 absorbs the thermal energy of the outdoor air and the indoor apparatus 200 emits the thermal energy to the indoor.

As mentioned above, the branched port may be connected to at least one indoor apparatus 200. For example, a single branched port may be connected to a plurality of indoor apparatuses which is installed in the same place or an adjacent place. Accordingly, as described below, a manager may perform a group-control in each group for each branched port, via the remote control apparatus 400.

In addition, the plurality of indoor apparatuses connected to the same branched port may be operated according to the same operation mode or an operation mode, which does not generate the mixing operation. For example, as illustrated in FIG. 3, in a state in which the first indoor apparatus 200-1, the second indoor apparatus 200-2, and the third indoor apparatus 200-3 are connected to the first branched port (P1), when the first indoor apparatus 200-1 is operated in the cooling mode, and the second indoor apparatus 200-2 and the third indoor apparatus 200-3 are operated in the heating mode, the circulation of the refrigerant may be different and thus it may lead to errors and damages in the components of the air conditioning apparatus 1.

According to embodiments, the air conditioning apparatus 1 may determine an operation mode for each branched port according to a mixing operation prevention process, and the air conditioning apparatus 1 may prevent the mixing operation by controlling the indoor apparatus 200 based on a result of the determination. In addition, although a user input a control command, which may cause the mixing operation, the air conditioning apparatus 1 may invalidate the control command. Hereinafter each component of the air conditioning apparatus 1 will be described.

Figure 5:
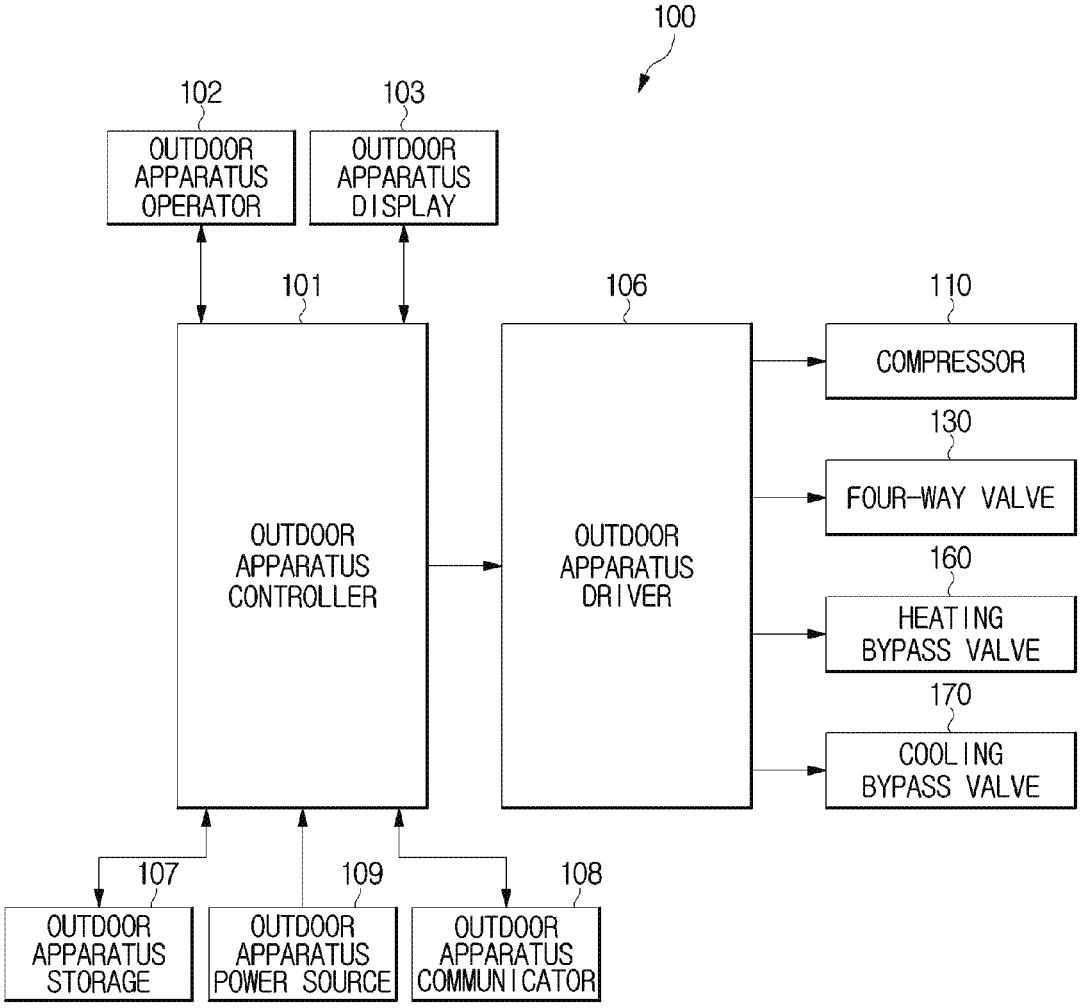
FIG. 5 illustrates a control block diagram of an outdoor apparatus of an air conditioning apparatus in accordance with various embodiments of the present disclosure.

FIG. 5 illustrates a control block diagram of the outdoor apparatus of the air conditioning apparatus 1 in accordance with various embodiments of the present disclosure.

Referring to FIG. 5, the outdoor apparatus 100 may include an outdoor apparatus operator 102 configured to receive a variety of control command from a user or a manager, an outdoor apparatus display 103 configured to display an operation of the air conditioning apparatus 1, e.g., an operation state of the outdoor apparatus 100, an outdoor apparatus driver 106 configured to drive the compressor 110, the four-way valve 130, the heating bypass valve 160 and the cooling bypass valve 170 provided in the outdoor apparatus 100, an outdoor apparatus storage 107 configured to store programs and data related to the operation of the outdoor apparatus 100, an outdoor apparatus communicator 108 configured to transmit and receive a variety of data by being connected to at least one of the indoor apparatus 200 and the central control apparatus 300 contained in the air conditioning apparatus 1, via the communication network, an outdoor apparatus power source 109 configured to supply the power to each component contained in the outdoor apparatus 100, and an outdoor apparatus controller 101 configured to control the operation of the outdoor apparatus 100 as a whole.

At least one of the outdoor apparatus controller 101, the outdoor apparatus driver 106, the outdoor apparatus storage 107 and the outdoor apparatus communicator 108 may be integrated in system-on-chip (SOC) embedded in the outdoor apparatus 100 and may be operated by a processor. However, the outdoor apparatus 100 may not be provided with only one system-on-chip, and thus it is not limited to being integrated into one system-on-chip.

The outdoor apparatus operator 102 may include an input device configured to receive a control command related to the outdoor apparatus 100 or the air conditioning apparatus 1 from a user. For example, the outdoor apparatus operator 102 may include a button type switch, a membrane switch or a display panel, which is implemented in a touch screen type. In addition, the outdoor apparatus operator 102 may include a remote controller configured to remotely receive a control command from a user and remotely transmit the received control command to the outdoor apparatus display 103.

The outdoor apparatus display 103 may include a display panel to display an operation state of the outdoor apparatus 100 or the air conditioning apparatus 1. For example, the outdoor apparatus display 103 may include a Cathode Ray Tube (CRT) display panel, a Liquid Crystal Display (LCD) panel, a Light Emitting Diode (LED) panel, an Organic Light Emitting Diode (OLED), a Plasma Display Panel (PDP), and a Field Emission Display (FED) panel, but is not limited thereto.

When the outdoor apparatus display 103 is implemented by using a display panel in a touch screen type, the outdoor apparatus display 103 may perform a function of the outdoor apparatus operator 102. That is, as illustrated in FIG. 5, the outdoor apparatus operator 102 and the outdoor apparatus display 103 may be separately illustrated due to the difference in the function of the outdoor apparatus operator 102 and the outdoor apparatus display 103, but the outdoor apparatus operator 102 and the outdoor apparatus display 103 may be physically integrated.

The outdoor apparatus driver 106 may drive the compressor 110, the four-way valve 130, the heating bypass valve 160 and the cooling bypass valve 170 according to the control command of the outdoor apparatus controller 101. Particularly, the heating bypass valve 160 may include an inverter configured to supply the driving current to a compressor motor to drive the compressor 110.

The outdoor apparatus storage 107 may store a variety of data. For example, the outdoor apparatus storage 107 may include volatile memory configured to temporarily store data, such as Static Random Access Memory (S-RAM) and Dynamic Random Access Memory (D-RAM). The outdoor apparatus storage 107 may include non-volatile memory configured to store a variety of control program and/or control data for long term, such as Read Only Memory, Erasable Programmable Read Only Memory (EPROM), Electrically Erasable Programmable Read Only Memory (EEPROM) and flash memory.

In the outdoor apparatus storage 107, the control program and the control data to control the operation of the outdoor apparatus 100 may be stored. In addition, data, which is generated during the operation of the outdoor apparatus 100 may be stored in the outdoor apparatus storage 107.

The outdoor apparatus storage 107 may store a program configured to determine whether an error occurs in the indoor apparatus 200 and to determine a level of error based on the state information of the indoor apparatus 200. The outdoor apparatus controller 101 may determine whether an error occurs by using the program stored in the outdoor apparatus storage 107, and the outdoor apparatus controller 101 may determine whether to stop the entire operation of the air conditioning apparatus 1 or to stop an operation of some component of the air conditioning apparatus 1 according to the level of the error. A detail description thereof will be described later.

The outdoor apparatus communicator 108 may receive or transmit data from or to the indoor apparatus 200, the central control apparatus 300, the remote control apparatus 400 or an external device via a variety of communication methods.

The outdoor apparatus communicator 108 may receive or transmit a variety of signals from or to an external device via at least one communication method between a wired communication method and a wireless communication method. For example, the outdoor apparatus communicator 108 may include at least one of a wired communication module and a wireless communication module.

The wired communication module may represent a module configured to support the wired communication. The wired communication method may include a method configured to transmit and receive a wired signal via a wired cable such as high definition multimedia interface (HDMI), Peripheral Component Interconnect (PCI), PCI-express and Universe Serial Bus (USB), but is not limited thereto. The wired communication module may include a wired communication method well-known in the art.

The wireless communication module may represent a module configured to support the wireless communication. The wireless communication method may include a wireless communication method configured to transmit and receive a wireless signal via a base station, such as long-term evolution (LTE), LTE Advance (LTE-A), code division multiple access (CDMA), and wideband CDMA (WCDMA). In addition, the wireless communication method may include a wireless communication method configured to transmit and receive a wireless signal to and from an external device, which is placed in a certain range, wireless LAN, Wi-Fi, Bluetooth, Z-wave, ZigBee, Bluetooth Low Energy (BLE), and Near Field Communication (NFC). The wireless signal may include various types of data according to a voice call signal, a video call signal or transmission and reception of text/multimedia message.

The wired communication module may correspond to an integrated chip (IC) or an IC package in which a communication module is integrated to support at least one wired communication method, and the wireless communication module may correspond to an integrated chip (IC) or an IC package in which a communication module is integrated to support at least one wireless communication method. Hereinafter for the convenience of description, when it is not required to distinguish the communication method into the wired communication method and the wireless communication method, it will be called as the communication method. In addition, when it is not required to distinguish the communication network into the wired communication network and the wireless communication network, it will be called as the communication network.

According to a connection state or a connection type of the communication network of the outdoor apparatus communicator 108, the outdoor apparatus communicator 108 may directly receive the state information of the indoor apparatus 200 from the indoor apparatus 200 or the outdoor apparatus communicator 108 may receive the state information of the indoor apparatus 200 via the central control apparatus 300 or the remote control apparatus 400 connected to the indoor apparatus 200.

Referring to FIG. 5, the outdoor apparatus 100 may be provided with the outdoor apparatus power source 109.

The outdoor apparatus power source 109 may include a power supply module (not shown) which is provided with a rectifier circuit rectifying an external power and a smoothing circuit removing a ripple contained in the rectified power so as to supply the direct current power. The outdoor apparatus power source 109 may apply the driving voltage to components of the outdoor apparatus 100 so that the outdoor apparatus 100 is driven normally.

Meanwhile, the outdoor apparatus controller 101 configured to control the entire operation of the outdoor apparatus 100 may be provided in the outdoor apparatus 100.

The outdoor apparatus controller 101 may include a processor capable of processing a variety of calculation, e.g., a Micro Control Unit (MCU). The outdoor apparatus controller 101 may generate a control signal and control an operation of components of the outdoor apparatus 100 in response to the generated control signal.

For example, when a cooling request is received from the remote control apparatus 400 via the outdoor apparatus communicator 108, the outdoor apparatus controller 101 may control the outdoor apparatus communicator 108 in response to the control signal so that the cooling request reception signal is transmitted to the third outdoor apparatus 200-3 (refer to FIG. 4). In addition, the outdoor apparatus controller 101 may control the outdoor apparatus driver 106 in response to the control signal to allow the compressor 110 to be operated. The outdoor apparatus controller 101 may control the outdoor apparatus communicator 108 in response to the control signal so that a third cooling value 310-3 (refer to FIG. 4) open request signal is transmitted to the central control apparatus 300.

As another example, the outdoor apparatus controller 101 may determine whether an error occurs in the indoor apparatus 200 based on the state information of the indoor apparatus 200 received through the outdoor apparatus communicator 108. When it is determined that the error occurs, the outdoor apparatus controller 101 may determine a level of the error, i.e., the outdoor apparatus controller 101 may determine how much the error affects the air conditioning apparatus 1. The outdoor apparatus controller 101 may determine a degree of effect in which the state of the indoor apparatus 200 affects the air conditioning apparatus 1, by using programs stored in the outdoor apparatus storage 107.

Accordingly, based on the result of the determination, the outdoor apparatus controller 101 may determine which operation among an operation of the air conditioning apparatus 1, an operation of an indoor apparatus in which the error is detected, or an operation of another indoor apparatus which is connected through the same branched port as the indoor apparatus in which the error is detected is to be stopped. The outdoor apparatus controller 101 may transmit the result of the determination to at least one of the outdoor apparatus 100, the central control apparatus 300 and the remote control apparatus 400 via the outdoor apparatus communicator 108.

In this time, it may be not limited to the outdoor apparatus controller 101 configured to determine whether the error occurs or not, and configured to perform the determination of the level of the error. Therefore, the central controller 301 of the central control apparatus 300 described later may be configured to determine whether the error occurs or not, and configured to perform the determination of the level of the error. Therefore, a detail description of the above mentioned operation will be described with reference to the central control apparatus 300. Hereinafter a description of the central control apparatus 300 will be described in details.

Figure 6:
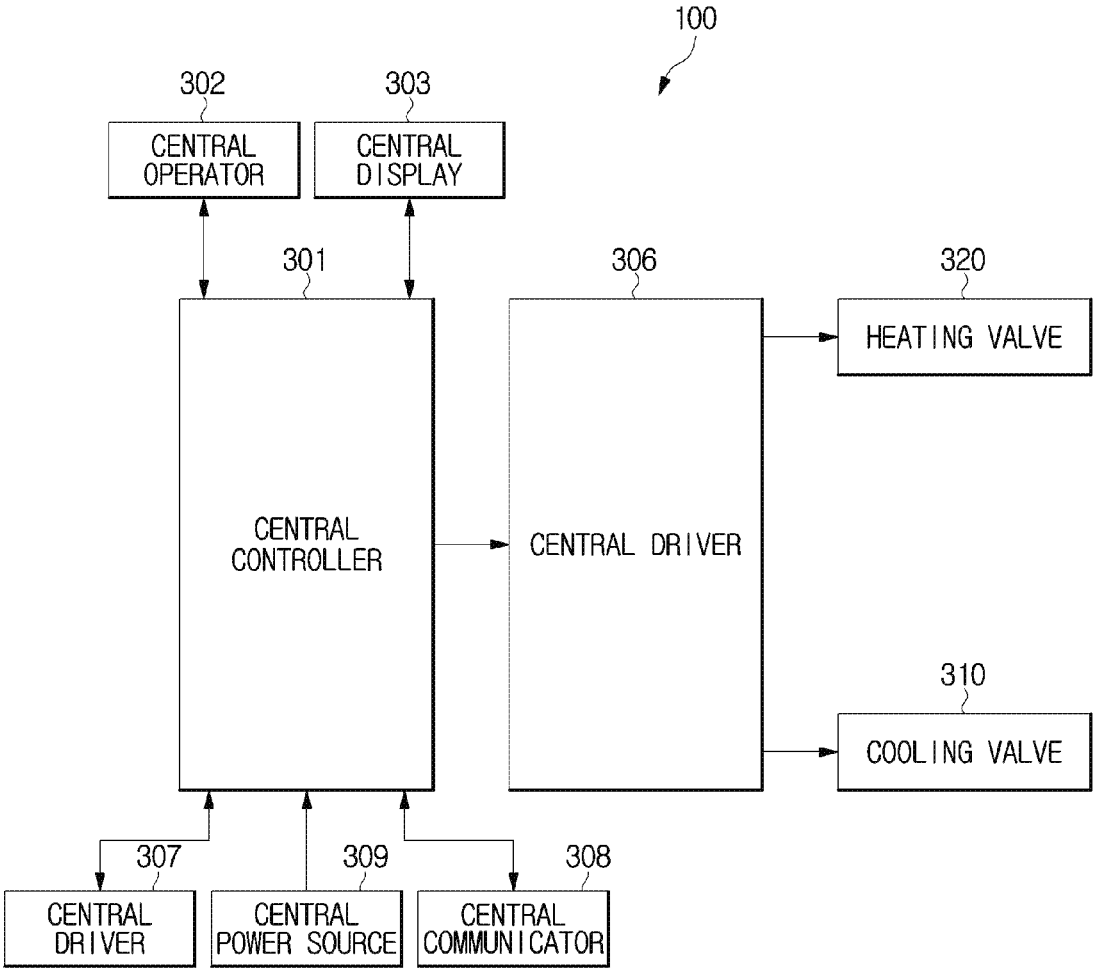
FIG. 6 illustrates a control block diagram of a central control apparatus of an air conditioning apparatus in accordance with various embodiments of the present disclosure.
Figure 7:
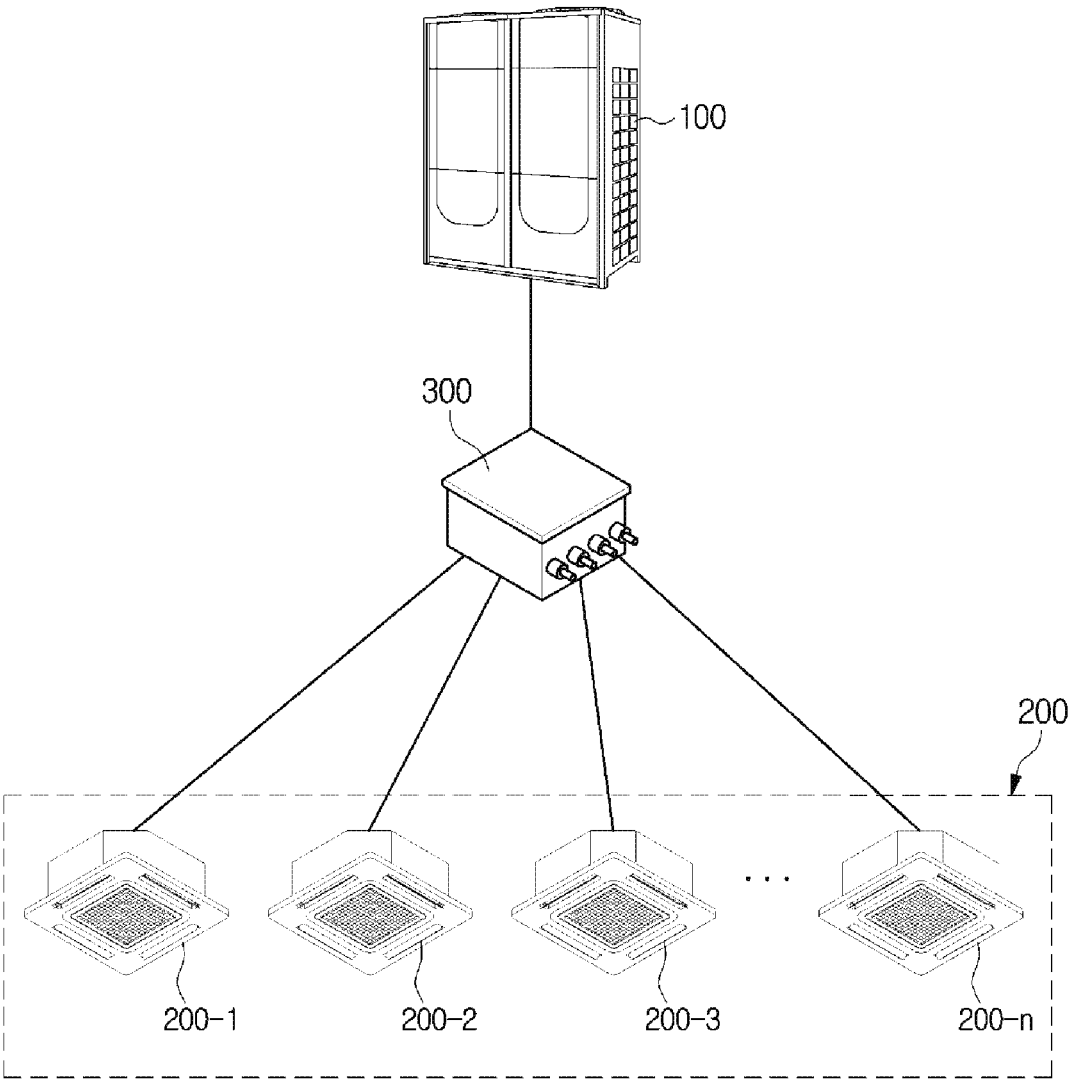
FIGS. 7 and 8 illustrates views of a communication connection among components of an air conditioning apparatus in accordance with different embodiments.
Figure 8:
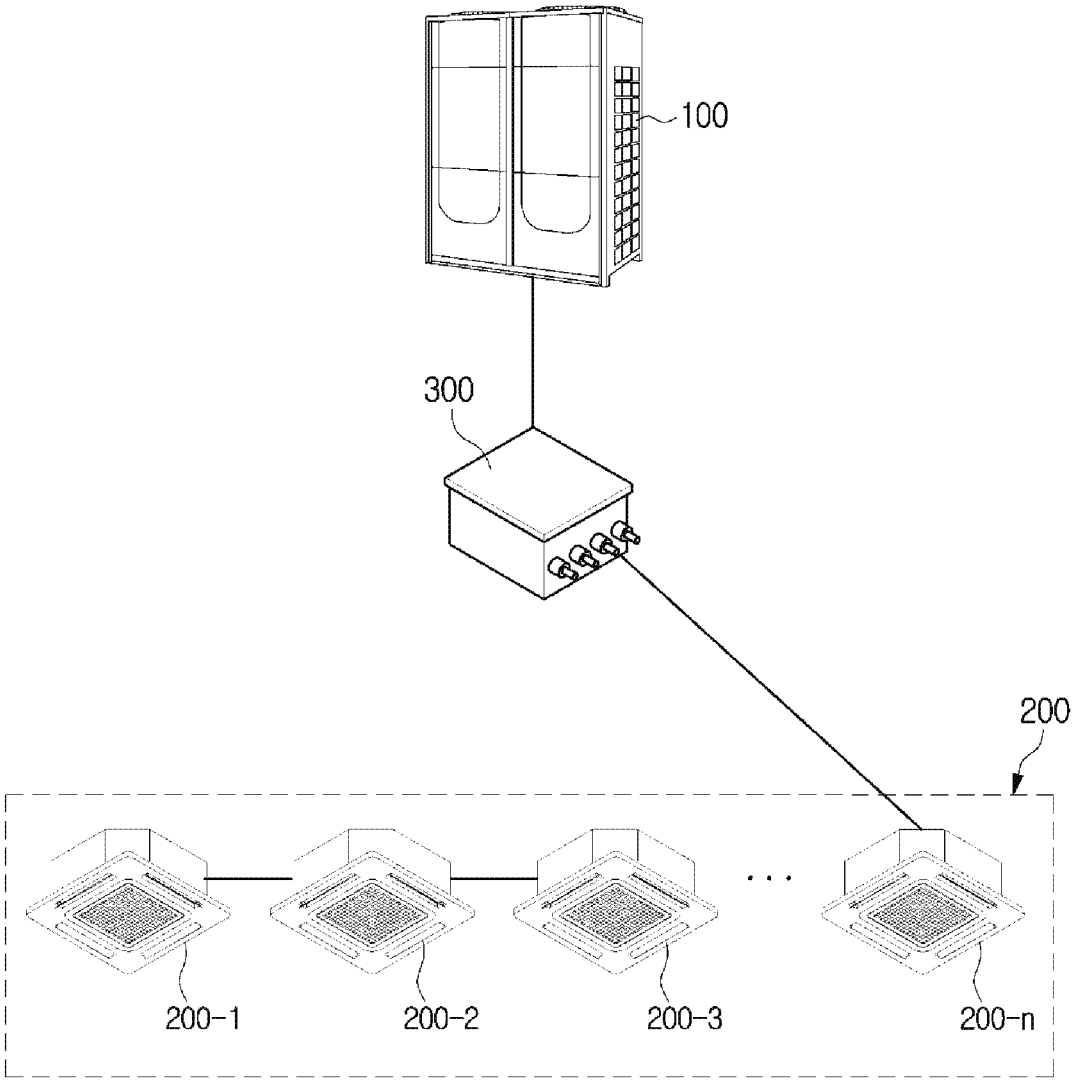
Figure 9:
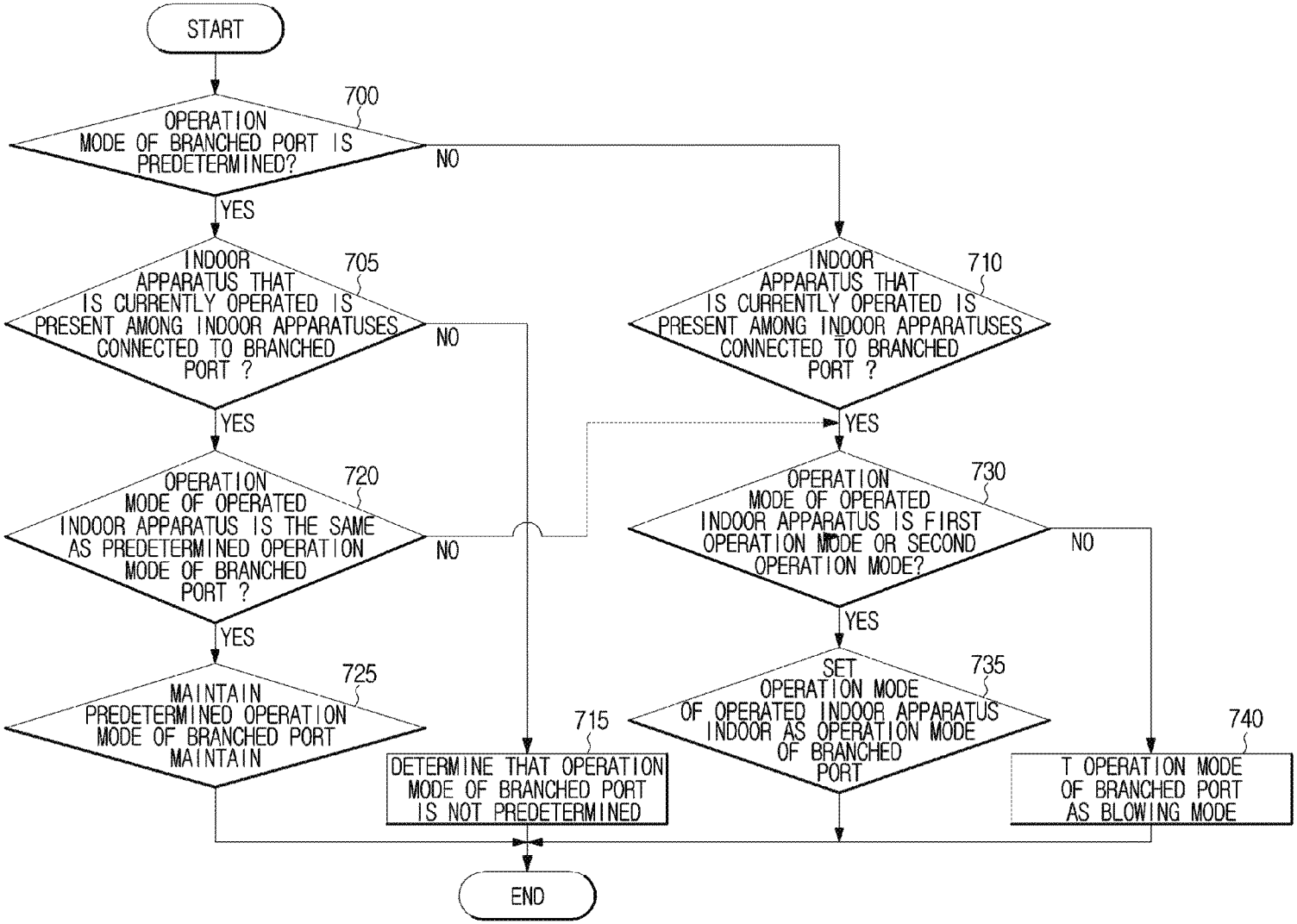
FIG. 9 illustrates a control flow chart of an operation to determine an operation mode of the branched port of an air conditioning apparatus in accordance with various embodiments of the present disclosure.
Figure 10:
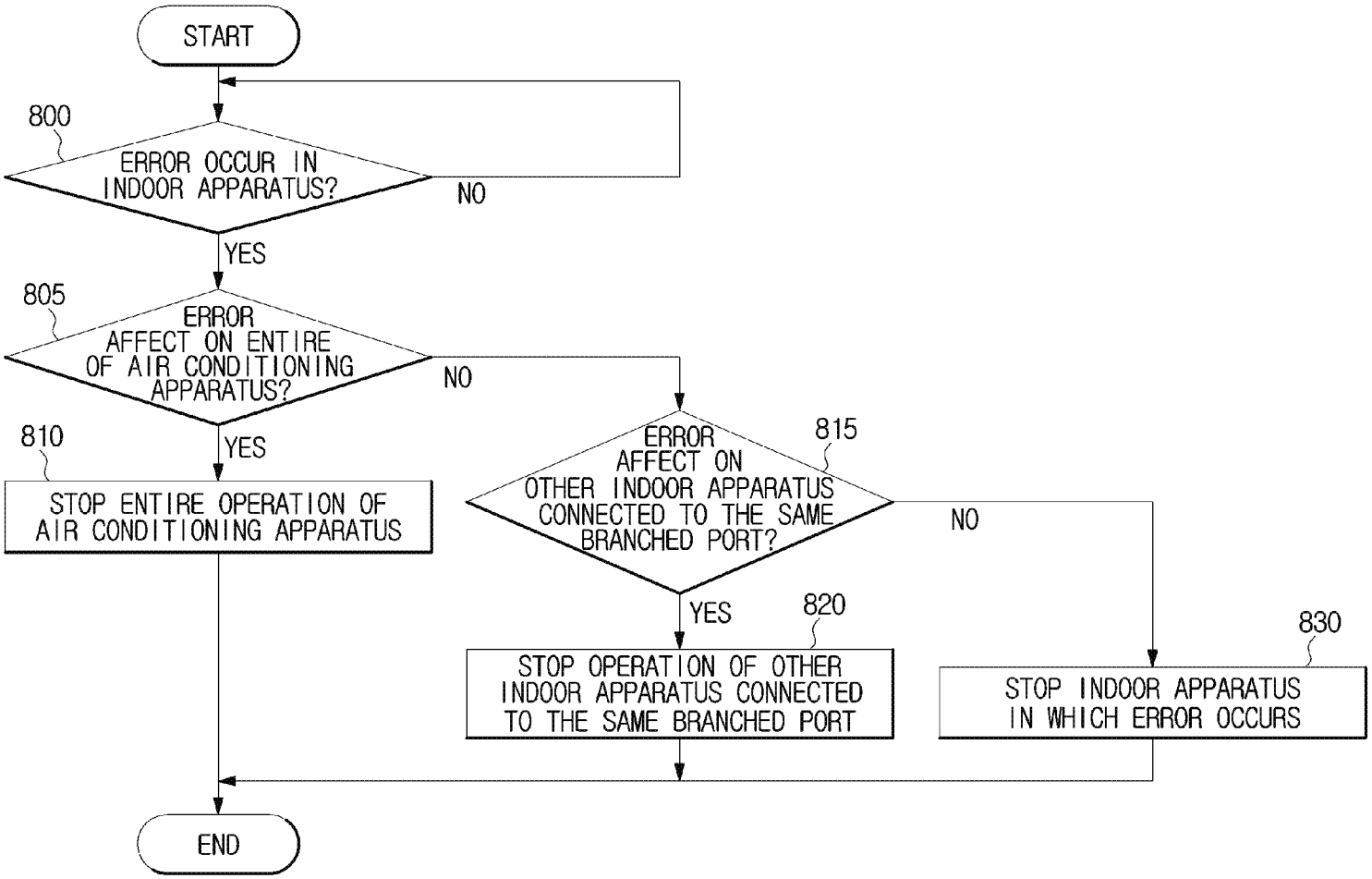
FIG. 10 illustrates a control flow chart of an operation to perform response actions according to an occurrence of an error and a level of the error in an air conditioning apparatus in accordance with various embodiments of the present disclosure.

FIG. 6 illustrates a control block diagram of the central control apparatus of the air conditioning apparatus in accordance with an embodiment, and FIGS. 7 and 8 illustrate views of a communication connection among components of the air conditioning apparatus in accordance with various embodiments of the present disclosure. FIG. 9 illustrates a control flow chart illustrating an operation to determine an operation mode of the branched port of the air conditioning apparatus in accordance with an embodiment, and FIG. 10 illustrates a control flow chart illustrating an operation to perform response actions according to the occurrence of the error and the level of the error in the air conditioning apparatus in accordance with an embodiment. Hereinafter a description thereof will be described together to avoid a duplicate description.

Referring to FIG. 6, the central control apparatus 300 includes a central operator 302 configured to receive a variety of control command from a user or a manager, a central display 303 configured to display an operation of the central control apparatus 300, a central driver 306 configured to drive a heating valve 320, and a cooling valve 310 contained in the central control apparatus 300, a central storage 307 configured to store programs and data related to the operation of the central control apparatus 300, a central communicator 308 configured to perform a communication with the outdoor apparatus 100, and the indoor apparatus 200 contained in the air conditioning apparatus 1, a central power source 309 configured to supply the power to each component contained in the central control apparatus 300, and a central controller 301 configured to control the operation of the central control apparatus 300 as a whole.

At least one of the central controller 301, the central driver 306, the central storage 307 and the central communicator 308 may be integrated in system-on-chip (SOC) embedded in the central control apparatus 300 and may be operated by a processor. However, the central control apparatus 300 may not be provided with only one system-on-chip, and thus it is not limited to being integrated into one system-on-chip.

The central operator 302 may include a button type switch or a membrane switch configured to receive a control command related to the central control apparatus 300, e.g., the input of the power, and the central display 303 may include a display panel configured to display the operation state of the central control apparatus 300, e.g., a connection state between the branched port and the indoor apparatus 200.

For example, the display panel may be implemented by a Cathode Ray Tube (CRT) display panel, a Liquid Crystal Display (LCD) panel, a Light Emitting Diode (LED) panel, an Organic Light Emitting Diode (OLED), a Plasma Display Panel (PDP), or a Field Emission Display (FED) panel, but is not limited thereto.

As the outdoor apparatus operator 102 and the outdoor apparatus display 103, the central operator 302 and the central display 303 may be separately illustrated due to the difference in the function of the central operator 302 and the central display 303, as illustrated in FIG. 6, but the central operator 302 and the central display 303 may be physically integrated. As needed, the central operator 302 and the central display 303 may be omitted in the central control apparatus 300 but is not limited to the drawings.

The central driver 306 may drive the cooling valve 310 and the heating valve 320 according to the control command of the central controller 301. Particularly, the central driver 306 may generate a driving current and provide the driving current to the heating valve 320 and the cooling valve 310 so as to open and close the heating valve 320 and the cooling valve 310.

The central storage 307 may store a variety of data. For example, the central storage 307 may include volatile memory configured to temporarily store data, such as S-RAM and D-RAM. The central storage 307 may include non-volatile memory configured to store a variety of control program and/or control data for long term, such as ROM, EPROM, EEPROM and flash memory.

In the central storage 307, data for controlling at least one component of the air conditioning apparatus 1 may be pre-stored. Identification information about the branched port may be pre-stored in the central storage 307. For example, identification information corresponding to each branched port may be predetermined and may be pre-stored in the central storage 307.

According to an embodiment, the central control apparatus 300 may be provided in each floor in the building. For example, the central control apparatus 300 may be provided in from the first floor to the fourth floor to control indoor apparatuses installed in each floor.

The plurality of branched ports may be installed in each central control apparatus 300 provided in each floor, and identification information may be predetermined in the plurality of branched ports. Accordingly, a manager only needs to input identification information of branched port, which is used for the plurality of indoor apparatuses, via the remote control apparatus 400.

For example, six branched ports may be provided in a central control apparatus provided in the first floor. Identification information 0A, 0B, 0C, 0D, 0E, and 0F may be respectively predetermined in a first branched port to a sixth branched port of the central control apparatus provided in the first floor. In addition, six branched ports may be provided in a central control apparatus provided in the second floor. Identification information 1A, 1B, 1C, 1D, 1E, and 1F may be respectively predetermined in a first branched port to a sixth branched port of the central control apparatus provided in the second floor.

A manager may connect the indoor apparatus 200 to any one of the plurality of branched ports and then input the identification information of the branched port connected to the indoor apparatus 200, through the remote control apparatus 400. The remote control apparatus 400 may directly transmit matching information between the indoor apparatus 200 and the branched port, to the central control apparatus 300 via the communication network, or transmit the matching information to the central control apparatus 300 via the outdoor apparatus 100. Accordingly, the interworking between the central control apparatus 300 and the indoor apparatus 200 may be completed.

In the conventional manner, to interwork the central control apparatus with the indoor apparatus, it may be that identification information of the indoor apparatus is set for each of the plurality of indoor apparatuses, identification information of branched port is set for each of the plurality of branched ports, and a manual setting about identification information of the indoor apparatus connected to each branched port is performed. In other words, according to the conventional manner, it may be that the manual setting is set by one to one matching (1:1) to interlock the central control apparatus with the indoor apparatus.

In addition, according to the conventional manner, an element may be embedded in the central control apparatus to set identification information corresponding to each branched port. For example, a rotary switch may be embedded in the central control apparatus to set identification information corresponding to each branched port. However, according to embodiments, since the identification information is predetermined in the branched port, the manager only needs to input identification information via the central control apparatus 300.

In addition, since the identification information is predetermined in the branched port for each branched port, the manger may input matching information between the branched port and the indoor apparatus via the remote control apparatus 400, and when the central control apparatus 300 receives matching information via any type of device through the communication network, the interlocking may be completed. According to embodiments, an additional physical component, which is to set identification information for each branched port, may not be in the central control apparatus 300.

According to the conventional manner, in order to set one to one (1:1) manual, the central control apparatus may be directly connected with the indoor apparatus via the communication network. However, according to embodiment of the present disclosure, the central control apparatus may not be directly connected with the indoor apparatus via the communication network as long as the connection information is transmitted between the central control apparatus and the indoor apparatus.

Accordingly, the implementation of the communication network in the air conditioning apparatus 1 may vary. Particularly, when components of the air conditioning apparatus 1 are connected to each other via the wired communication network, a wired cable may be freely connected and thus a length of the wired cable, which is used for the interworking, may be reduced.

According to the conventional manner, as illustrated in FIG. 7, the connection of the communication network may be used between each of the plurality of indoor apparatuses 200 and the central control apparatus 300. However, according to embodiments, when the central control apparatus 300 is connected to any one of the plurality of indoor apparatuses 200 according to the communication network as illustrated in FIG. 8, as well as the communication network as illustrated in FIG. 7, the interworking with the plurality of indoor apparatuses 200 may be performed. In addition, in a state in which the plurality of indoor apparatuses 200 is connected to the remote control apparatus 400 or the outdoor apparatus 100 via the communication network, when the central control apparatus 300 receives the matching information from the remote control apparatus 400 or the outdoor apparatus 100, the interworking may be available, but is not limited thereto.

The central communicator 308 may receive or transmit a variety of data from or to components in the air conditioning apparatus 1 or an external device. The central communicator 308 may receive or transmit a variety of signals from or to an external device via at least one communication method between the wired communication method and the wireless communication method. For example, the central communicator 308 may include at least one of the wired communication module and the wireless communication module. The detail description thereof has been described and thus it will be omitted.

The central communicator 308 may receive connection information between the indoor apparatus and the branched port via the communication network. In this time, according to a connection state or a connection type of the communication network of the central communicator 308, the central communicator 308 may directly receive the connection information from the remote control apparatus 400 or the central communicator 308 may receive the connection information via the outdoor apparatus 100 or the indoor apparatus 200, but is not limited thereto.

The central communicator 308 may receive the state information of the indoor apparatus 200. For example, according to the communication state or the connection state of the communication network of the central communicator 308, the central communicator 308 may directly receive the state information of the indoor apparatus 200 from the indoor apparatus 200 or the central communicator 308 may receive the state information of the indoor apparatus 200 via the outdoor apparatus 100 or the central control apparatus 300.

In addition, the central communicator 308 may transmit information about an operation mode for each branched port, to the indoor apparatus 200. In this time, according to the communication state or the connection state of the communication network, the central communicator 308 may directly transmit the information about an operation mode to the indoor apparatus 200 or transmit the information about an operation mode to the indoor apparatus 200 via the outdoor apparatus 100 or the central control apparatus 300.

Referring to FIG. 6, the central control apparatus 300 may be provided with the central power source 309.

The central power source 309 may include a power supply module (not shown) which is provided with a rectifier circuit rectifying an external power and a smoothing circuit removing a ripple contained in the rectified power so as to supply the direct current power. The central power source 309 may apply the driving voltage to components of the central control apparatus 300 so that the central control apparatus 300 is driven normally.

Meanwhile, the central controller 301 configured to control the entire operation of the central control apparatus 300 may be provided in the central control apparatus 300.

The central controller 301 may include a processor capable of processing a variety of calculation, e.g., a Micro Control Unit (MCU). The central controller 301 may generate a control signal and control an operation of components of the central control apparatus 300 in response to the generated control signal.

The central controller 301 may control the operation of components contained in the central control apparatus 300 as a whole. For example, when a third cooling value 310-3 (refer to FIG. 4) open request is received from the outdoor apparatus 100 via the central communicator 308, the central controller 301 may control the central communicator 308 so that the valve open request reception signal is transmitted to the outdoor apparatus 100 and control the central driver 306 so that the third cooling value 310-3 (refer to FIG. 4) is opened.

The central controller 301 may determine an operation mode of the branched port, and transmit a result of the determination to the indoor apparatus so that the mixing operation is prevented. In this time, the central controller 301 may determine an operation for each of the plurality of branched ports. Hereinafter a method for determining an operation for each of the plurality of branched ports will be described.

Referring to FIG. 9, the central controller 301 may determine whether a predetermined operation mode is present for each branched port (700). The central controller 301 may determine whether the operation mode for each branched port is present, according to a predetermined period or a manger's request. "Predetermined operation mode" may represent an operation of a branched port that is set in an initial state or an operation mode of a branched port that is determined in a previous period.

When it is determined that the operation mode of the branched port is predetermined, the central controller 301 may determine whether any one of the plurality of indoor apparatuses connected to the branched port is currently operated (705). Particularly, the central controller 301 may determine whether the indoor apparatus is operated based on state information, which is about the plurality of indoor apparatuses connected to the branched port and received via the central communicator 308. In addition, although it is determined that the operation mode of the branched port is not predetermined, i.e., the operation mode of the branched port is not determined, the central controller 301 may determine whether any one of the plurality of indoor apparatuses connected to the branched port is currently operated (710).

Regardless of whether the operation mode of the branched port is predetermined, when all of the plurality of indoor apparatuses connected to the branched port is not operated, the central controller 301 may determine that the operation mode of the branched port is not predetermined, i.e., the central controller 301 may determine that the operation mode of the branched port is not present. That is, since any one of the plurality of indoor apparatuses connected to the same branched port is not operated, the mixing operation may be not performed regardless of the operation mode of the indoor apparatus 200. Therefore, according to embodiments, the central controller 301 may determine that the operation of the branched port is not predetermined and the central controller 301 may transmit the result of the determination to the indoor apparatus 200. Accordingly, the indoor apparatus 200 may be freely operated based on a user control command or the environment of the indoor.

When it is determined that any one of the plurality of indoor apparatuses connected to the branched port is currently operated, the central controller 301 may determine whether the operation mode of the indoor apparatus, which is currently operated, is the same as a predetermined operation mode of the branched port (720). A concept of the same operation mode may include the same operation itself, e.g., a case in which the first indoor apparatus and the second indoor apparatus are operated in the heating mode, and a case in which the device failure or the error caused by the different refrigerant circulation method are not generated.

When it is determined that the operation mode of the indoor apparatus that is currently operated is the same as the predetermined operation of the branched port, the central controller 301 may determine to maintain the predetermined operation of the branched port (725). In addition, the central controller 301 may control the central communicator 308 so that the result of the determination is transmitted to the indoor apparatus 200.

When it is determined that the operation mode of the indoor apparatus that is currently operated is not the same as the predetermined operation of the branched port, or when it is determined that an indoor apparatus which is currently operated is present among the plurality of indoor apparatuses connected to the branched port, the central controller 301 may determine whether the indoor apparatus which is currently operated is in the first operation mode or the second operation mode (730). "The first operation mode" may be the cooling mode or a dehumidification mode and "the second operation mode" may be the heating mode.

When it is determined that the indoor apparatus is operated in the first operation mode or the second operation mode, the central controller 301 may determine the operation mode of the indoor apparatus, which is currently operated, as the operation of the branched port, not the predetermined operation mode (735). The determination of the operation of the branched port is to prevent the problems caused by the mixing operation. Therefore, the central controller 301 may determine the operation mode of the indoor apparatus, which is currently operated, as the operation of the branched port, so that another indoor apparatus connected to the same branched port does not cause a problem due to the mixing operation at a later operation.

As another example, when it is determined that the indoor apparatus is not operated in the first operation mode or the second operation mode, the central controller 301 may determine the operation of the branched port as a blowing mode (740).

According to embodiments, the central controller 301 may periodically update the operation mode of the branched port by applying the operation mode of the indoor apparatus, which is currently operated, so that the mixing operation is prevented when another indoor apparatus is operated at a later time.

The central controller 301 may control the central communicator 308 so that information about the determined operation mode of the branched port is transmitted to the indoor apparatus 200. When the indoor apparatus 200 receives the control command about the operation mode from a user, the indoor apparatus 200 may perform a mixing operation prevention process configured to determine the validity of the control command, based on the information about the operation mode of the branched port. A detail description thereof will be described later.

In addition, the central controller 301 may control the operation of the air conditioning apparatus 1 based on the state information of the indoor apparatus 200 that is collected via the central communicator 308.

For example, the central controller 301 may determine whether an error occurs in the indoor apparatus 200 and determine the level of the error in the indoor apparatus 200, based on the state information of the indoor apparatus 200. Therefore, the central controller 301 may determine which component among components of the air conditioning apparatus 1 is to be stopped, based on the result of the determination of the occurrence of the error and the level of the error.

Embodiments described later will be performed by the central controller 301, but is not limited thereto. The embodiment will be performed by the outdoor apparatus controller 101 of the outdoor apparatus 100. Hereinafter for the convenience of description, a case in which the central controller 301 performs the operation will be described.

Referring to FIG. 10, the central controller 301 may determine whether an error occurs in the indoor apparatus 200, based on the state information of the indoor apparatus 200 collected via the central communicator 308 (800). In this time, the central controller 301 may determine whether an error occurs in the indoor apparatus 200 according to a predetermined period or in response to a manage request command. When it is determined that the error does not occur in the indoor apparatus 200, the central controller 301 may determine again whether an error occurs in the indoor apparatus 200, according to the predetermined period or in response to the manage request command.

When it is determined that the error occurs in the indoor apparatus 200, the central controller 301 may determine whether the error occurring in the indoor apparatus 200 affects the entire of the air conditioning apparatus 1 or not (805). The method for determining the occurrence of the error and the level of the error may be implemented by data in the program type and then stored in the central storage 307.

When it is determined that the error occurring in the indoor apparatus 200 affects the entire of the air conditioning apparatus 1, the central controller 301 may control the air conditioning apparatus 1 by using the control signal so that the entire of the air conditioning apparatus 1 is stopped (810). For example, the central controller 301 may transmit an air conditioning apparatus stop signal to the outdoor apparatus 100, the indoor apparatus 200 and the remote control apparatus 400 of the air conditioning apparatus 1 via the communication network, so that the operation of all components of the air conditioning apparatus 1 is stopped.

When it is determined that the error occurring in the indoor apparatus 200 does not affect the entire of the air conditioning apparatus 1, the central controller 301 may determine whether the error occurring in the indoor apparatus 200 affects another indoor apparatus connected to the branched port (815).

When it is determined that the error occurring in the indoor apparatus 200 affects another indoor apparatus connected to the branched port, the central controller 301 may allow all of indoor apparatuses connected to the branched port to be stopped (820). When it is determined that the error occurring in the indoor apparatus 200 does not affect another indoor apparatus connected to the branched port, the central controller 301 may allow an indoor apparatus 200, in which the error is detected among the indoor apparatuses connected to the branched port, to be stopped.

Therefore, according to embodiments, the central controller 301 may perform a group control in the plurality of indoor apparatuses connected to a single branched port. In addition, the remote control apparatus 400 may display a user interface, which is configured to make the group control easier, on the remote display 403. A detail description thereof will be described later and hereinafter a detail description of the indoor apparatus 200 will be described.

Figure 11:
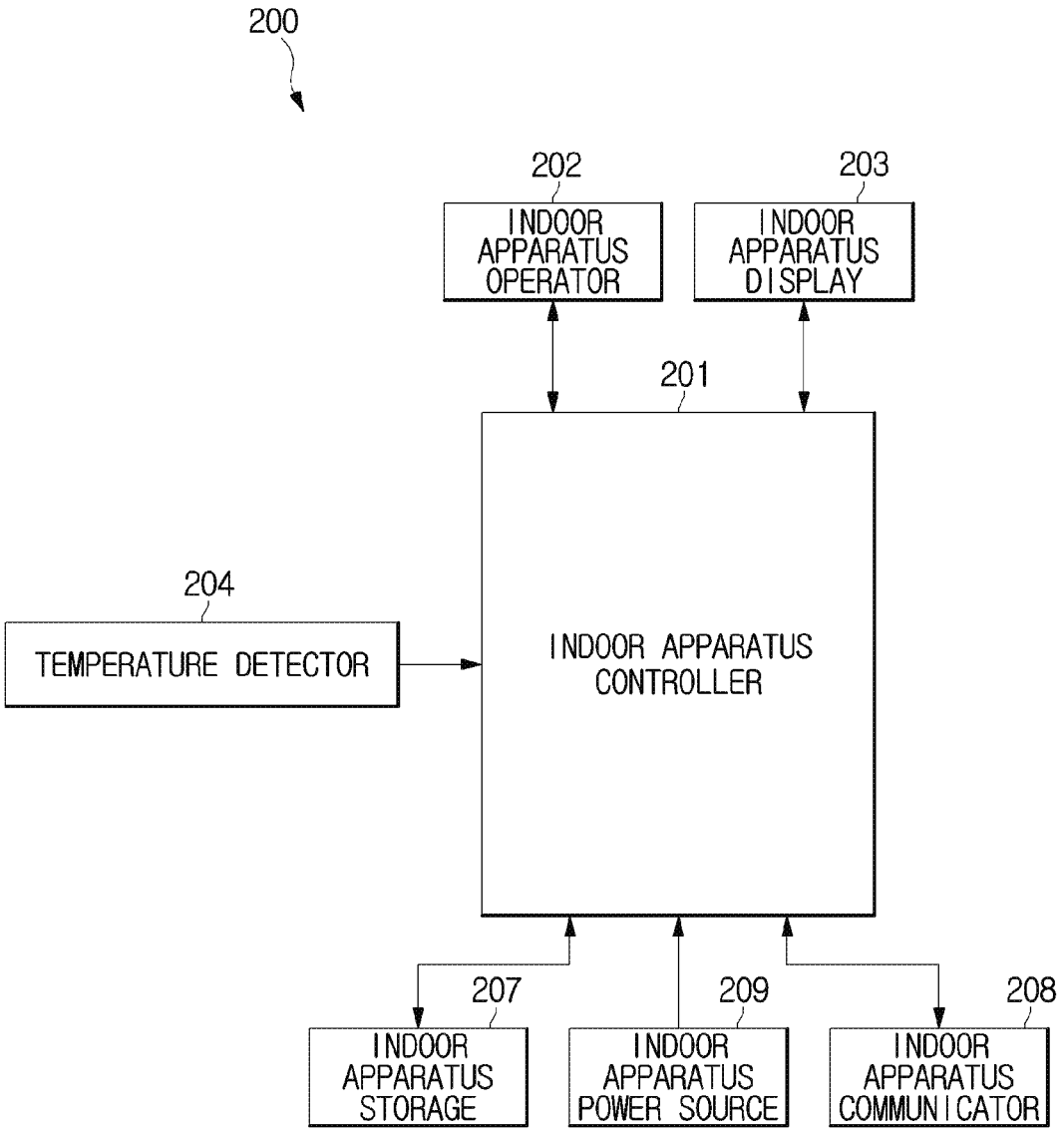
FIG. 11 illustrates a control block diagram of an indoor apparatus of an air conditioning apparatus in accordance with various embodiments of the present disclosure.
Figure 12:
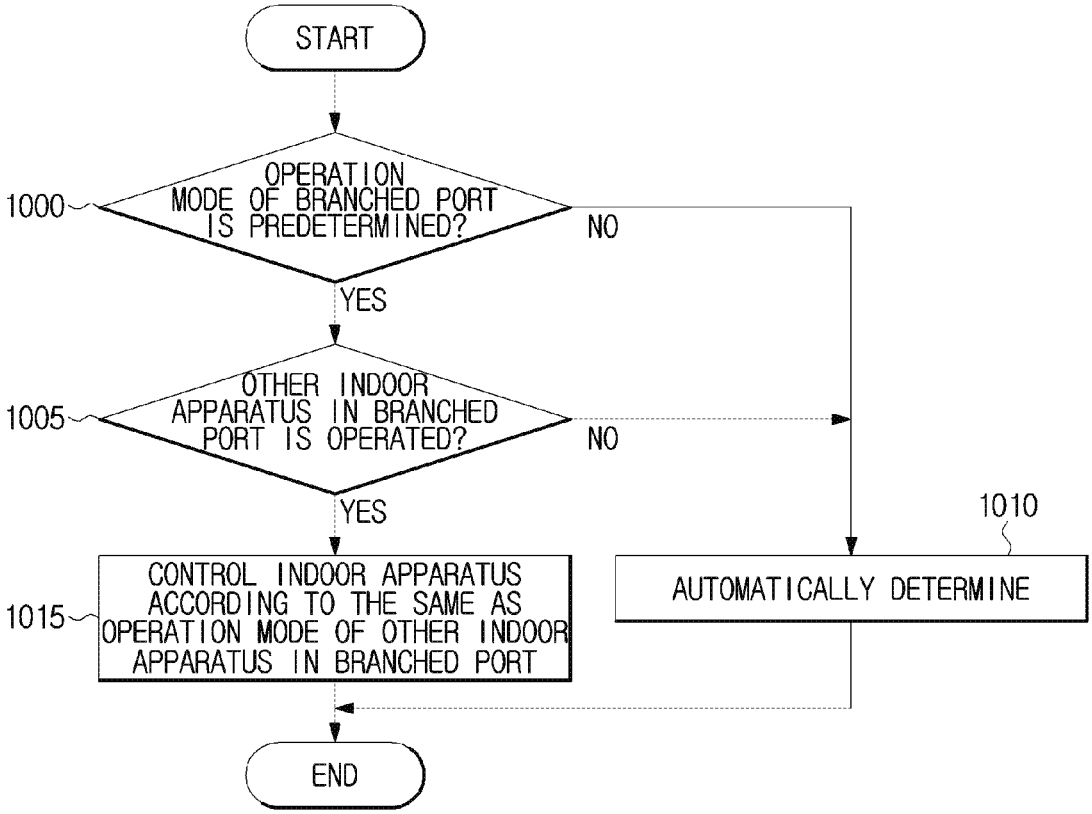
FIG. 12 illustrates a flowchart of a case in which the air conditioning apparatus selects an operation mode based on an operation of a branched port in a state in which an automatic mode is received, in accordance with various embodiments of the present disclosure.
Figure 13:
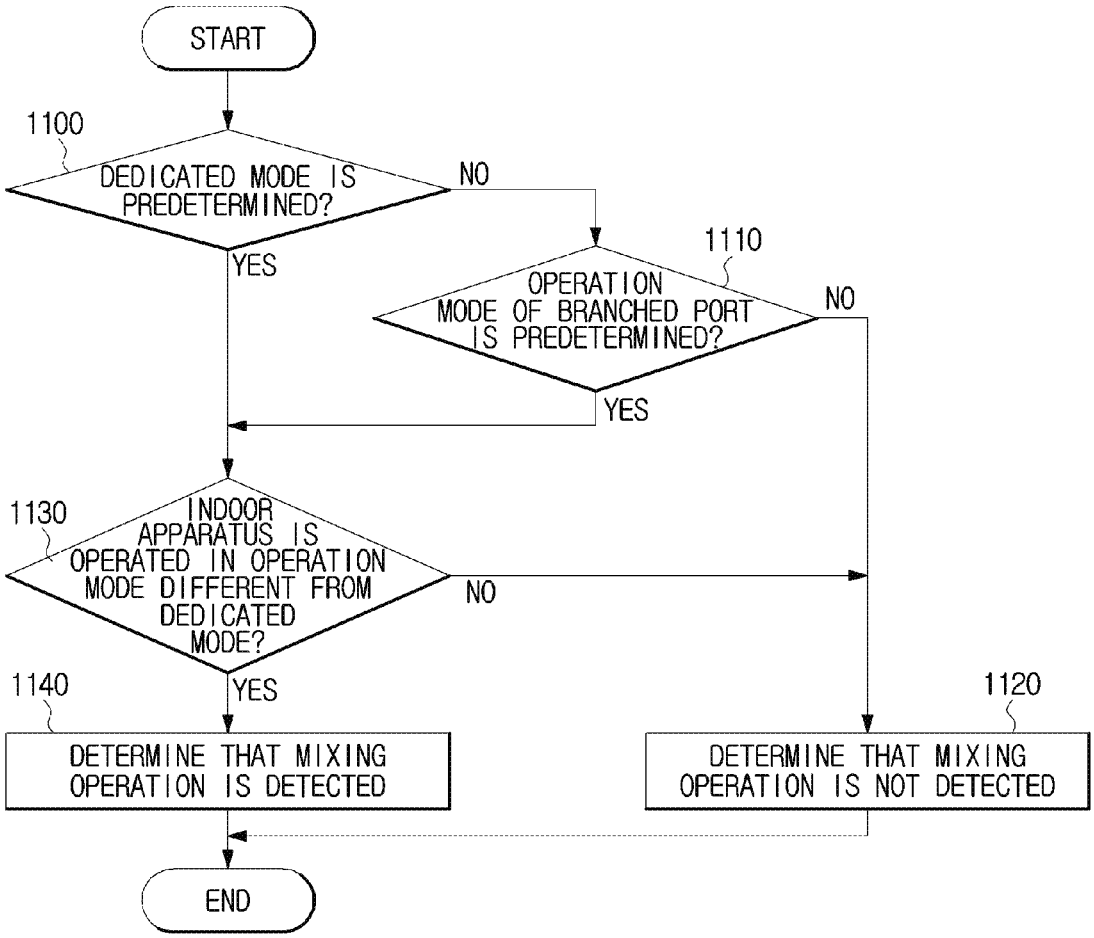
FIG. 13 illustrates a flowchart of a case in which an air conditioning apparatus detects a mixing operation mode in accordance with various embodiments of the present disclosure.

FIG. 11 illustrates a control block diagram of the indoor apparatus of the air conditioning apparatus in accordance with an embodiment, FIG. 12 illustrates a flowchart of a case in which the air conditioning apparatus selects an operation mode based on an operation of a branched port in a state in which an automatic mode is received, in accordance with an embodiment, and FIG. 13 illustrates a flowchart of a case in which the air conditioning apparatus detects a mixing operation mode in accordance with an embodiment. Hereinafter a description thereof will be described together to avoid a duplicate description.

The indoor apparatus 200 may include an indoor apparatus operator 202 configured to receive a variety of control command from a user, an indoor apparatus display 203 configured to display operation information of the indoor apparatus 200, a temperature detector 204 configured to detect a temperature of the indoor in which the indoor apparatus 200 is placed, an indoor apparatus storage 207 configured to store control programs and control data to control the operation of the indoor apparatus 200, an indoor apparatus communicator 208 configured to perform a communication with the outdoor apparatus 100, another indoor apparatus, the central control apparatus 300 and the remote control apparatus 400 contained in the air conditioning apparatus 1, an indoor apparatus power source 209 configured to supply the power to each component contained in the indoor apparatus 200, and an indoor apparatus controller 201 configured to control the operation of components of the indoor apparatus 200.

At least one of the indoor apparatus controller 201, the indoor apparatus storage 207 and the indoor apparatus communicator 208 may be integrated in system-on-chip (SOC) embedded in the indoor apparatus 200 and may be operated by a processor. However, the indoor apparatus 200 may not be provided with only one system-on-chip, and thus it is not limited to being integrated into one system-on-chip.

The indoor apparatus operator 202 may include a button type switch or a membrane switch configured to receive a control command related to the indoor apparatus 200, e.g., the input of the power, and the indoor apparatus display 203 may include a display panel configured to display the operation state of the indoor apparatus 200.

For example, the display panel may be implemented by a Cathode Ray Tube (CRT) display panel, a Liquid Crystal Display (LCD) panel, a Light Emitting Diode (LED) panel, an Organic Light Emitting Diode (OLED), a Plasma Display Panel (PDP), or a Field Emission Display (FED) panel, but is not limited thereto.

The air conditioning apparatus 1 may include the remote control apparatus 400 configured to receive a control command about components of the air conditioning apparatus 1 and to display the operation state about the components of the air conditioning apparatus 1, and thus the indoor apparatus operator 202 may include a power display light emitting diode (LED) (not shown) indicating whether the power is supplied to the indoor apparatus 200, and an operation display LED (not shown) indicating whether the indoor apparatus 200 is operated, but is not limited thereto.

As the outdoor apparatus operator 102 and the outdoor apparatus display 103, the indoor apparatus operator 202 and the indoor apparatus display 203 may be separately illustrated due to the difference in the function of the indoor apparatus operator 202 and the indoor apparatus display 203, as illustrated in FIG. 11, but the indoor apparatus operator 202 and the indoor apparatus display 203 may be physically integrated. As needed, the indoor apparatus operator 202 and the indoor apparatus display 203 may be omitted in the indoor apparatus 200 but is not limited to the drawings.

The temperature detector 204 may detect the temperature in the indoor space in which the indoor apparatus 200 is placed, and output an electrical signal corresponding to the detected temperature. For example, the temperature detector 204 may include a thermistor in which an electrical resistance changes with the temperature.

The indoor apparatus storage 207 may store a variety of data. For example, the indoor apparatus storage 207 may include volatile memory configured to temporarily store data, such as S-RAM and D-RAM. The indoor apparatus storage 207 may include non-volatile memory configured to store a variety of control program and/or control data for long term, such as ROM, EPROM, EEPROM and flash memory.

For example, in the indoor apparatus storage 207, data for controlling at least one component of the indoor apparatus 200 may be pre-stored. According to an embodiment, in the indoor apparatus storage 207, a variety of control program and control data may be provided in the indoor apparatus storage 207 to control components of the indoor apparatus 200 in response a user control command.

According to another embodiment, data and programs in algorithm types, which is used to detect the error state of the indoor apparatus 200, may be stored in the indoor apparatus storage 207. According to another embodiment, an algorithm, which is configured to detect the mixing operation according to a dedicated mode and the operation mode of the branched port, may be implemented in data and program type and stored in the indoor apparatus storage 207. According to another embodiment, an algorithm, which is configured to determine an appropriate operation mode based on the operation mode of the branched port and the indoor temperature when receiving the automatic mode, may be implemented in data and program type and stored in the indoor apparatus storage 207. In addition, a control signal, which is transmitted to at least one of the remote control apparatus 400, the central control apparatus 300, and the outdoor apparatus 100, may be temporarily stored in the indoor apparatus storage 207.

The indoor apparatus communicator 208 may receive or transmit a variety of data from or to components in the air conditioning apparatus 1 or an external device. The indoor apparatus communicator 208 may receive or transmit a variety of signals from or to an external device via at least one communication method between the wired communication method and the wireless communication method. For example, the indoor apparatus communicator 208 may include at least one of the wired communication module and the wireless communication module. The detail description thereof has been described and thus it will be omitted.

The indoor apparatus communicator 208 may receive connection information between the indoor apparatus and the branched port via the communication network. In this time, according to a communication state or a connection state of the communication network of the indoor apparatus communicator 208, the indoor apparatus communicator 208 may directly receive the connection information from the remote control apparatus 400 or the indoor apparatus communicator 208 may receive the connection information via the outdoor apparatus 100 or the indoor apparatus 200, but is not limited thereto.

The indoor apparatus power source 209 may perform supplying the power to components of the indoor apparatus 200 to drive the indoor apparatus 200 normally. For example, the indoor apparatus power source 209 may include a rectifier circuit rectifying the power supplied from the outside and a smoothing circuit removing a ripple contained in the rectified power.

Referring to FIG. 11, the indoor apparatus controller 201 configured to control the entire operation of the indoor apparatus 200 may be provided in the indoor apparatus 200. The indoor apparatus controller 201 may include a processor capable of processing a variety of calculation, e.g., a Micro Control Unit (MCU). The indoor apparatus controller 201 may generate a control signal and control an operation of components of the indoor apparatus 200 in response to the generated control signal.

For example, when an indoor temperature corresponding to the result of the detection of the temperature detector 204 is higher than a target cooling temperature, the indoor apparatus controller 201 may control the indoor apparatus communicator 208 by using the control signal so that the cooling request signal is transmitted to the outdoor apparatus 100. In addition, through the control signal, the indoor apparatus controller 201 may allow the indoor apparatus display 203 to display an indication indicating that the air conditioning apparatus 1 performs the cooling operation.

The indoor apparatus controller 201 may receive information about the operation mode of the branched port to which the indoor apparatus 200 is connected, via the indoor apparatus communicator 208. A method for determining the operation mode of the branched port has been described and thus a description thereof will be omitted.

The indoor apparatus controller 201 may perform the mixing operation prevention process based on the received information about the operation mode of the branched port.

As mentioned above, the central control apparatus 300 may control the cooling valve 310 (refer to FIG. 4) and the heating valve 320 (refer to FIG. 4) which are configured to control the flow of the refrigerant according to the cooling mode or the heating mode. Therefore, when in the blowing mode in which the air flowing from the outdoor apparatus 100 is supplied without the change, there may be no difficulties in controlling the cooling and heating valve. However, when among the plurality of indoor apparatuses 200 connected to the same branched port, any one thereof is in the cooling mode and another thereof is in the heating mode, there may be difficulties in the circulation of the refrigerant and thus it may cause the occurrence of the error and the damage in the apparatus.

According to embodiments, although the air conditioning apparatus 1 receives a control command about setting an operation mode from a user, the air conditioning apparatus 1 may determine whether to validate or invalidate the control command, based on the operation mode of the branched port. Accordingly, according to embodiments, the air conditioning apparatus 1 may prevent the occurrence of the error and the damage in the apparatus at an early stage. Hereinafter the mixing operation prevention process will be described.

For example, when the indoor apparatus controller 201 receives a control command such as a conversion to a certain operation mode or an operation start command, via the remote control apparatus 400, the indoor apparatus controller 201 may determine whether to validate or invalidate the received control command by comparing the received control command with information about the operation mode of the branched port. In other words, the indoor apparatus controller 201 may determine whether to control an operation of the component of the indoor apparatus 200 to correspond to the received control command, by comparing received control command with information about the operation mode of the branched port.

According to an embodiment, the indoor apparatus controller 201 may perform a process of validating and invalidating the received control command as in the following table 1. The operation mode of the indoor apparatus may correspond to a control command received from a user via the remote control apparatus 400, and the operation mode of the branched port may be predetermined by the central control apparatus 300 and received.

TABLE 1

| | Operation mode of indoor apparatus | | | | |
|---|---|---|---|---|---|
| Operation mode of branched port | Automatic mode | Cooling mode | Dehumidification mode | Blowing mode | Heating mode |
| Cooling mode | Valid | Valid | Valid | Valid | Invalid |
| Heating mode | Valid | Invalid | Invalid | Valid | Valid |
| non | Valid | Valid | Valid | Valid | Valid |

According to the embodiment, the indoor apparatus controller 201 may compare the received control command with information about the operation mode of the branched port as illustrated in table 1, and thus it may be possible to prevent the occurrence of the mixing operation at an early stage, so that the occurrence of the error and the damage in the apparatus are minimized.

Meanwhile, the mixing operation prevention process may be performed although the conversion to the certain mode or the operation start command is not received from a user.

For example, when the automatic mode is received, the indoor apparatus controller 201 may automatically select an operation mode based on the temperature of the indoor detected by the temperature detector 204. According to an embodiment, when the automatic mode is received, the indoor apparatus controller 201 may select any one of the cooling mode, the dehumidification mode, the blowing mode, and the heating mode, based on the temperature of the indoor detected by the temperature detector 204.

In this time, the indoor apparatus controller 201 may select any one of the cooling mode, the dehumidification mode, the blowing mode, and the heating mode, based on the information about the operation mode of the branched port as well as the temperature of the indoor detected by the temperature detector 204. Hereinafter a method for determining an operation mode by considering the operation mode of the branched port in a state in which the automatic mode is received, will be described.

Referring to FIG. 12, when determining the operation mode, the indoor apparatus controller 201 may determine whether the operation mode of the branched port is predetermined (1000). The indoor apparatus communicator 208 may directly receive the information about the operation mode of the branched port from the central control apparatus 300, or receive the information about the operation mode of the branched port via the outdoor apparatus 100 or the remote control apparatus 400, but is not limited thereto.

When it is determined that the operation mode of the branched port is predetermined, the indoor apparatus controller 201 may determine whether another indoor apparatus connected to the same branched port is operated (1005). Operation information of another indoor apparatus may be received via the indoor apparatus communicator 208.

When all other indoor apparatuses connected to the same branched port are not operated, the mixing operation may not occur although the indoor apparatus controller 201 does not determine an operation mode by considering the predetermined operation mode of the branched port. Therefore, in a state in which the operation mode of the branched port is not predetermined or the operation mode of the branched port is predetermined, when all other indoor apparatuses connected to the same branched port are not operated, the indoor apparatus controller 201 may automatically determine an operation mode by considering the environment of the indoor (1010). For example, the indoor apparatus controller 201 may determine any one of the cooling mode, the dehumidification mode, the blowing mode, and the heating mode, based on the temperature of the indoor detected by the temperature detector 204.

When any other of the indoor apparatuses connected to the same branched port is operated, the indoor apparatus controller 201 may control the indoor apparatus 200 so that the indoor apparatus 200 is operated in the same operation mode as the operation of the other indoor apparatus connected to the same branched port (1015). A concept of the same operation mode may include the same operation itself, or an operation mode configured to not generate the mixing operation.

For example, when another indoor apparatus connected to the same branched port is operated in the cooling mode, the indoor apparatus controller 201 may determine any one of the cooling mode or the dehumidification mode, as the operation, based on the temperature of the indoor. In this time, according to the specification of the indoor apparatus 200, the indoor apparatus 200 may further include a sensor configured to detect the humidity and thus the indoor apparatus 200 may determine an operation mode by further considering a result of detection of the humidity of the indoor.

However, the mixing operation prevention process is not limited thereto. For example, a user interface, which is configured to actively prevent the mixing operation, may be displayed on the remote control apparatus 400. For example, a use interface, which is configured to prevent the mixing operation when receiving a control command related to the operation mode, may be displayed on the remote display 403 of the remote control apparatus 400. A detail description thereof will be described later.

In addition, the mixing operation prevention process may be performed although the indoor apparatus 200 is operated in the determined operation mode. For example, the indoor apparatus 200 may detect whether the mixing operation occurs or not although the indoor apparatus 200 is operated in the determined operation mode. That is, as well as when the indoor apparatus 200 receives a control command, the mixing operation prevention process may be performed when the indoor apparatus 200 determines the operation mode in response to the received control command, e.g., when the indoor apparatus 200 determines an operation mode according to the automatic mode, and when the indoor apparatus 200 performs an operation according the determined operation mode.

For example, referring to FIG. 13, the indoor apparatus controller 201 may determine whether the dedicated mode is predetermined (1100). "Dedicated mode" may represent an operation mode directly set by a manger via the remote control apparatus 400, in which a data management server configured to perform multiple control in the operation of the air conditioning apparatus 1, is embedded. In this time, the dedicated mode may be set for each group or for each indoor apparatus 200, but is not limited thereto. A detail description of the group of the indoor apparatus will be described later.

The indoor apparatus communicator 208 may directly receive information about the dedicated mode from the remote control apparatus 400 or receive the information via the central control apparatus 300 or the outdoor apparatus 100, but is not limited thereto.

When it is determined that the dedicated mode is not predetermined, the indoor apparatus controller 201 may determine whether the operation mode of the branched port is predetermined (1110). As mentioned above, the indoor apparatus communicator 208 may directly receive information about the operation mode of the branched port from the remote control apparatus 400 or receive the information via the central control apparatus 300 or the outdoor apparatus 100, but is not limited thereto.

When the dedicated mode is not predetermined and when the operation mode of the branched port is not predetermined, the indoor apparatus controller 201 may determine that the mixing operation is not detected (1120). For example, when any one of other indoor apparatuses connected to the same branched port is operated, the operation mode of the branched port may be set as the operation mode of the indoor apparatus, which is currently operated. Therefore, when the dedicated mode is not predetermined and when the operation mode of the branched port is not predetermined, the indoor apparatus controller 201 may determine that the mixing operation is not generated and thus the indoor apparatus controller 201 may maintain the operation mode that is currently operated.

When it is determined that the operation mode of the branched port is predetermined regardless of whether the dedicated mode is predetermined, the indoor apparatus controller 201 may determine whether an operation mode according to the dedicated mode is different from the operation mode that is currently operated (1130). The indoor apparatus controller 201 may determine whether the mixing operation is performed by periodically comparing the dedicated mode with the operation mode of the branched port, according to the predetermined period, and the indoor apparatus controller 201 may transmit the result of the determination to other apparatus of the air conditioning apparatus 1.

When it is determined that the operation mode of the branched port is predetermined regardless of whether the dedicated mode is predetermined, the indoor apparatus controller 201 may determine whether the indoor apparatus 200 is operated in an operation mode different from the dedicated mode (1130).

When it is determined that the indoor apparatus 200 is operated in an operation mode the same as the operation mode according to the dedicated mode, the indoor apparatus controller 201 may determine that the mixing operation is not detected (1120). When it is determined that the indoor apparatus 200 is operated in an operation mode different from the operation mode according to the dedicated mode, the indoor apparatus controller 201 may determine that the mixing operation is performed (1140). The operation mode different from the operation mode according the dedicated mode may represent an operation mode in which difficulties may occur when controlling the cooling valve 310 (refer to FIG. 4) and the heating valve (refer to FIG. 4) controlling the flow of the refrigerant.

Accordingly, the indoor apparatus controller 201 may perform a response process. For example, when the mixing operation is detected for equal to or longer than a predetermined period of time, the indoor apparatus controller 201 may control components of the indoor apparatus 200 so that the operation of the indoor apparatus 200 is stopped. Accordingly, the indoor apparatus controller 201 may prevent the damage in the apparatus at an early stage.

Hereinafter a description of the remote control apparatus 400 will be described in details.

Figure 14:
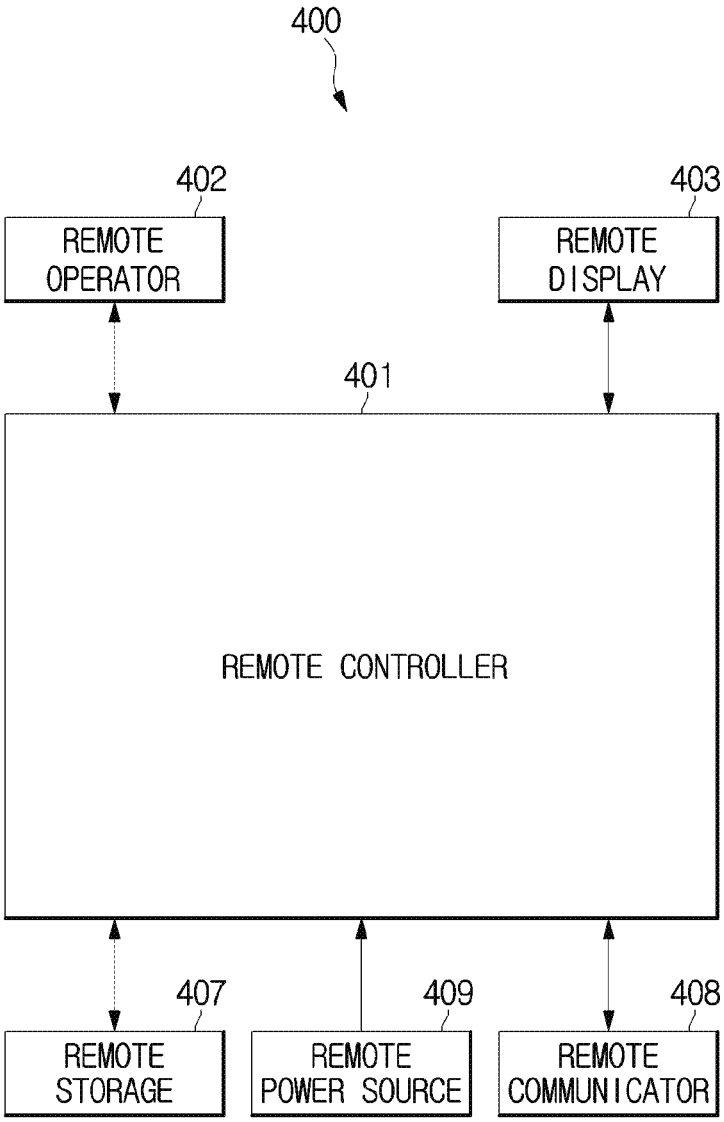
FIG. 14 illustrates a control block diagram of a remote control apparatus of an air conditioning apparatus in accordance with various embodiments of the present disclosure.
Figure 15:
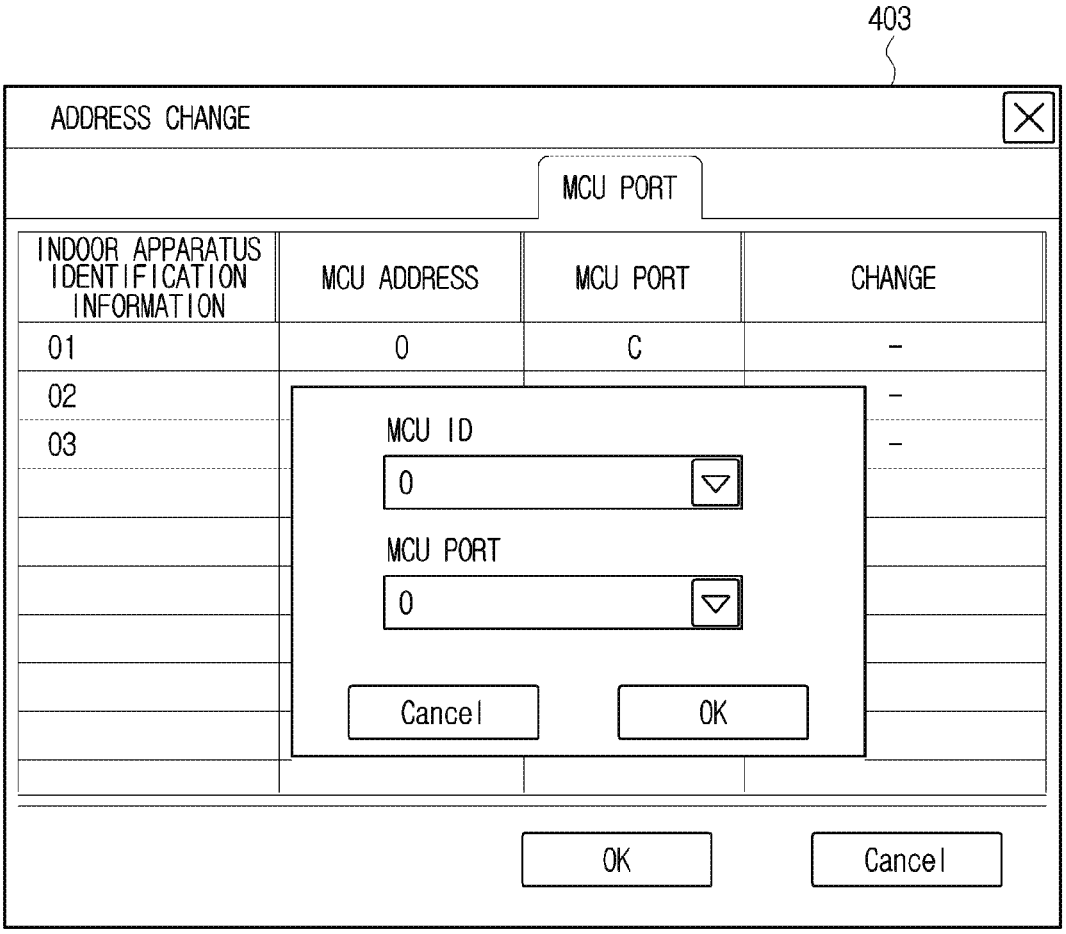
FIG. 15 illustrates a screen in which a user interface configured to receive matching information is displayed in accordance with various embodiments of the present disclosure.
Figure 16:
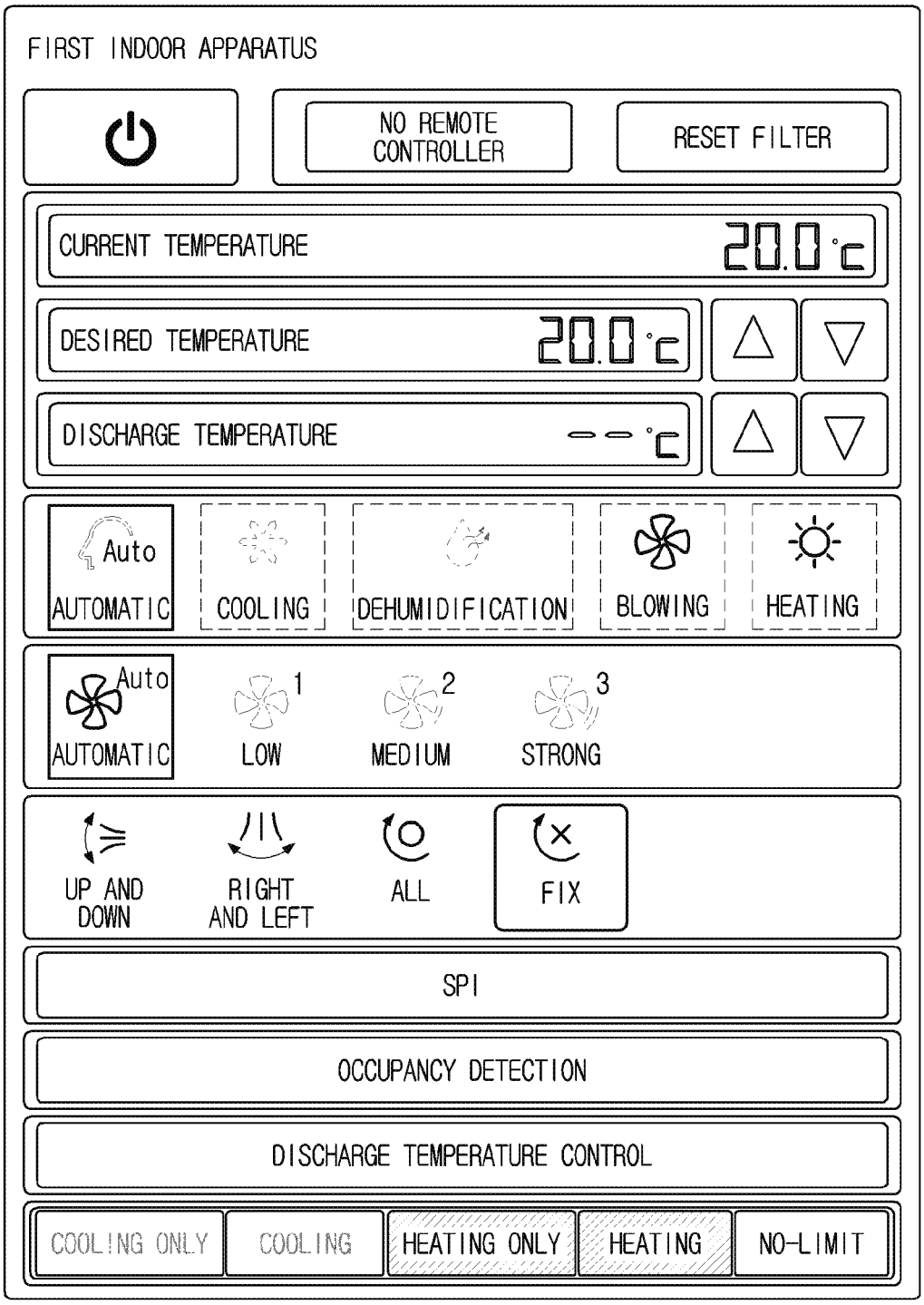
FIG. 16 illustrates a screen in which a user interface configured to receive an operation mode is displayed in accordance with various embodiments of the present disclosure.
Figure 17:
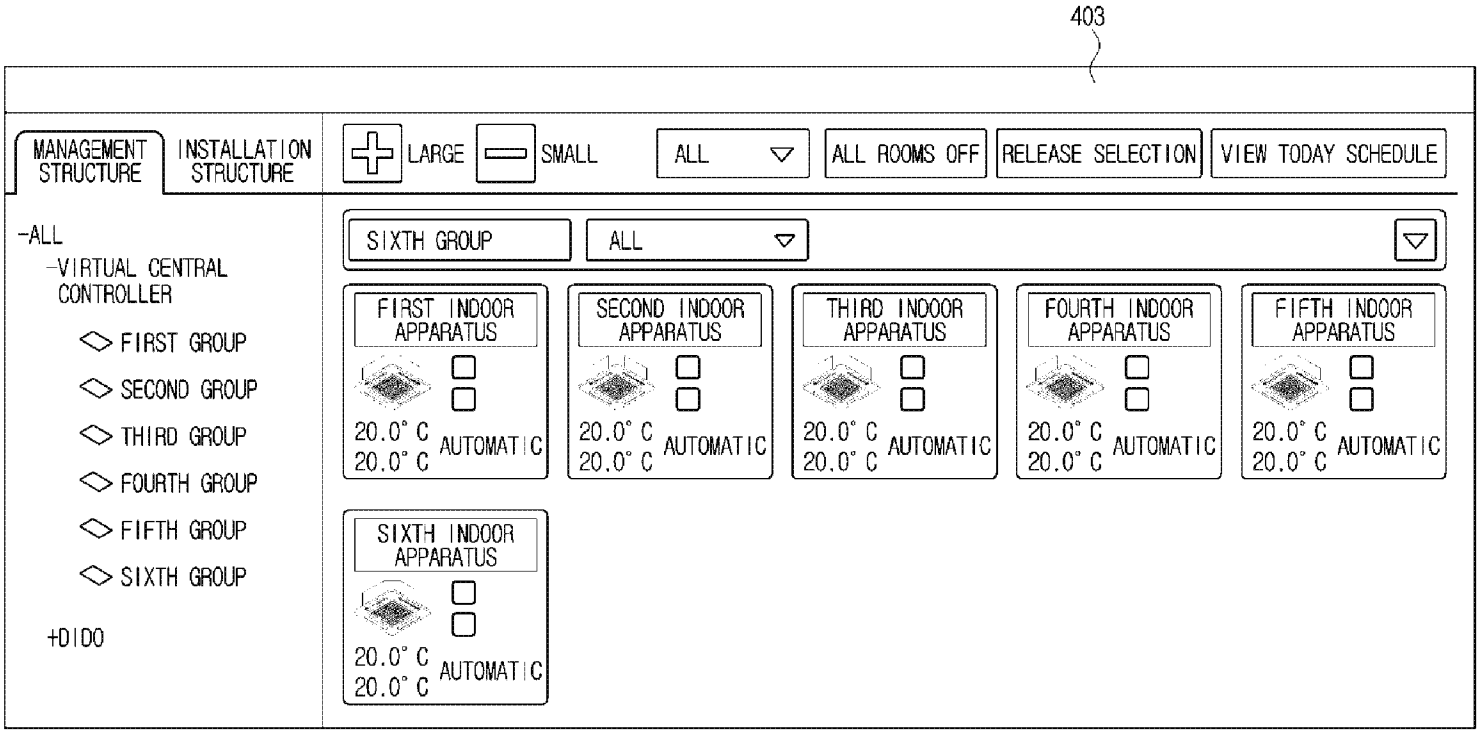
FIG. 17 illustrates a screen in which a user interface configured to perform a group control is displayed in accordance with various embodiments of the present disclosure.

FIG. 14 illustrates a control block diagram of the remote control apparatus of the air conditioning apparatus in accordance with an embodiment, FIG. 15 illustrates a screen in which a user interface configured to receive matching information, is displayed in accordance with various embodiments of the present disclosure, FIG. 16 illustrates a screen in which a user interface configured to receive an operation mode, is displayed in accordance with various embodiments of the present disclosure, and FIG. 17 illustrates a screen in which a user interface configured to perform a group control is displayed in accordance with various embodiments of the present disclosure. Hereinafter a description thereof will be described together to avoid a duplicate description.

Referring to FIG. 14, the remote control apparatus 400 includes a remote operator 402 configured to receive a variety of control command, a remote display 403 configured to display an operation of the indoor apparatus 200, a remote storage 407 configured to store programs and data to control the operation of the remote control apparatus 400, a remote communicator 408 configured to transmit and receive a variety of data to and from the outdoor apparatus 100, the indoor apparatus 200, and other remote control apparatus, a central power source 309 configured to supply the power to each component contained in the remote control apparatus 400, and a remote controller 401 configured to control the operation of the remote control apparatus 400 as a whole.

At least one of the remote controller 401, the remote storage 407 and the remote communicator 408 may be integrated in system-on-chip (SOC) embedded in the remote control apparatus 400 and may be operated by a processor. However, the remote control apparatus 400 may not be provided with only one system-on-chip, and thus it is not limited to being integrated into one system-on-chip.

The remote operator 402 may include a button type switch, a membrane switch, a keyboard and a mouse, which are configured to receive a control command related to the remote control apparatus 400, and the remote display 403 may include a display panel configured to display the operation state of the remote control apparatus 400.

For example, the display panel may be implemented by a Cathode Ray Tube (CRT) display panel, a Liquid Crystal Display (LCD) panel, a Light Emitting Diode (LED) panel, an Organic Light Emitting Diode (OLED), a Plasma Display Panel (PDP), or a Field Emission Display (FED) panel, but is not limited thereto.

As the outdoor apparatus operator 102 and the outdoor apparatus display 103, the remote operator 402 and the remote display 403 may be separately illustrated due to the difference in the function of the remote operator 402 and the remote display 403, as illustrated in FIG. 14, but the remote operator 402 and the remote display 403 may be physically integrated. For example, the display panel formed in the touch screen type may perform functions of the remote operator 402 and the remote display 403.

The remote storage 407 may store a variety of data. For example, the remote storage 407 may include volatile memory configured to temporarily store data, such as S-RAM and D-RAM. The remote storage 407 may include non-volatile memory configured to store a variety of control program and/or control data for long term, such as ROM, EPROM, EEPROM and flash memory.

For example, the remote storage 407 may store programs and data for controlling the operation of the remote control apparatus 400. According to an embodiment, in the remote storage 407, a variety control programs and control data for controlling the components of the air conditioning apparatus 1 to correspond to the user control command may be stored.

As another example, a method to implement a user interface, which is configured to receive a variety of control commands from a user and to provide the state information, may be implemented as an algorithm or data in the program type, and then stored in the remote storage 407. Accordingly, the remote controller 401 may display the user interface on the remote display 403 by using data stored in the remote storage 407.

The user interface may represent an environment which is configured to allow a user to easily control components of the air conditioning apparatus 1 and programs stored in the air conditioning apparatus 1, and to easily recognize a variety of information. Hereinafter the user interface may represent a graphical user interface, which is a screen implemented by graphics displayed on the remote display 403 and configured to allow the command and the variety of information between the user and the air conditioning apparatus 1 to be easily exchanged.

For example, the graphical user interface may be configured to display a variety of objects such as an icon and a button, to easily receive a variety of control commands from a user, and displayed on the screen displayed on the remote display 403. In addition, the graphical user interface may be implemented to display the operation information of the components of the air conditioning apparatus 1 on the screen displayed on the remote display 403. A detail description of the user interface may be described later.

In the remote storage 407, a control signal transmitted from at least one of the remote operator 402 of the remote control apparatus 400, the indoor apparatus 200, the central control apparatus 300 and the outdoor apparatus 100 may be temporarily stored, but is not limited thereto. Hereinafter a description of the remote controller 401 will be described later.

The remote control apparatus 400 may be provided with the remote controller 401 configured to control an entire operation of the remote control apparatus 400. The remote controller 401 may include a processor capable of processing a variety of calculation, e.g., a Micro Control Unit (MCU). The remote controller 401 may generate a control signal and control an operation of components of the remote control apparatus 400 in response to the generated control signal.

For example, when a temperature change command is input via the remote operator 402, the remote controller 401 may control the remote display 403 by using a control signal so that the remote display 403 displays a changed temperature. In addition, the remote controller 401 may control the remote communicator 408 by using a control signal so that information about changed temperature is transmitted to the indoor apparatus 200.

As another example, the remote controller 401 may control the remote display 403 so that the user interface is displayed on the remote display 403 based on data stored in the remote storage 407.

Identification information may be respectively assigned to at least one branched port provided in the central control apparatus 300. Accordingly, a manager connects the branched port to the indoor apparatus 200 via the remote control apparatus 400, and then inputs matching information between the branched port and the indoor apparatus 200. Matching information may represent information indicating the connection state between the branched port and the indoor apparatus 200.

When the identification information of the branched port is predetermined, the central control apparatus 300 may directly receive the matching information via the remote control apparatus 400 or receive via the indoor apparatus 200 or the outdoor apparatus 100, and thus there may be no limitation in the connection of the communication.

According to the conventional manner, identification information may be assigned to each branched port by using a rotary switch, and then it may be that the identification information of the branched port and the identification information of the indoor apparatus are shared between the indoor apparatus and the central control apparatus. Accordingly, the communication network is used to be directly connected between the indoor apparatus and the central control apparatus. However, according to the embodiment, the identification information is pre-assigned to the branched port of the central control apparatus 300. Therefore, after a manager identifies the branched port by using the identification information of the branched port, the manager may input the identification information of the indoor apparatus, which is to be connected to the identified branched port, via the remote control apparatus 400. According the connection state of the communication network, the remote control apparatus 400 may directly transmit setting information to the central control apparatus 300 or transmit the setting information via the outdoor apparatus 100 or the indoor apparatus 200. Accordingly, according to the embodiment, the restriction that the communication network is performed by the wire cable may be released. In addition, when the configuration is connected via the wireless communication method, it may be possible to identity the indoor apparatus connected to each branched port although the connection of the wireless communication is disconnected between the indoor apparatus 200 and the central control apparatus 300.

Referring to FIG. 15, the remote controller 401 may display the user interface, which is configured to allow a user to easily set a matching between the indoor apparatus and the branched port, on the remote display 403.

Referring to FIG. 15, the identification information of the branched port may be configured with MCU identification (ID), and MCU PORT. For example, as mentioned above, when identification information of from the first branched port to the sixth branched port of the central control apparatus 300 provided in the first floor is predetermined as 0A, 0B, 0C, 0D, 0E, and 0F, MCU ID of the first branched port may be 0 (zero), and MCU PORT may be A.

A parameter of the identification information of the branched port may be configured with MCU ID and MCU PORT, but is not limited thereto. The manager may check the user interface displayed on the remote display 403, and input the identification information of the branched port, which is used for each indoor apparatus, via the remote operator 402. Referring to FIG. 15, the matching information may include information indicating that an indoor apparatus having identification information of 01 is connected to a branched port having identification information of 0C, and information indicating that an indoor apparatus having identification information of 02 is connected to a branched port having identification information of 0A.

In addition, according to the embodiment, the air conditioning apparatus 1 may determine whether to validate or invalidate a control command based on the operation mode of the branched port according to the mixing operation prevention process, as mentioned above.

The remote controller 401 may display the user interface to which the result of the determination of validity is applied, on the remote display 403. FIG. 16 illustrates a screen having the user interface, which is configured to receive a control command about the first indoor apparatus, on the remote display 403.

Referring to FIG. 16, on the user interface, an operation state such as a current temperature, a temperature, and a discharge temperature may be displayed, and the user interface may further include a button formed in the arrow shape and configured to receive a control command about the temperature and the discharge temperature.

In addition, the user interface may include an icon related to performing the automatic mode, an icon (I1) related to performing the cooling mode, an icon (I2) related to performing the dehumidification mode, an icon (I3) related to performing the blowing mode, and an icon (I4) related to performing the heating mode. The user interface may include a button (B1) related to cooling only, a button (B2) related to cooling, a button (B3) related to heating only, and a button (B4) related to heating.

The user interface may allow an icon or a button, which is related to the operation mode which is validated, to be displayed differently from an icon or a button, which is related to the operation mode which is invalidated.

For example, when the operation mode of the branched port is the heating mode and other indoor apparatus connected to the same branched port is operated in the heating mode, the operation mode related to the cooling mode and the dehumidification mode may be invalidated. Accordingly, the remote controller 401 may display the user interface, which is configured to indicate the icon (I1) related to the cooling mode and the icon (I2) related to the dehumidification mode, as a dotted line, and configured to indicate the icon (I3) related to the blowing mode and the icon (I4) related to the heating mode, as a solid line, on the remote display 403. Since the remote controller 401 invalidates the icon in the dotted line, the remote controller 401 may invalidate an execution command although a user inputs an execution command by clicking or touching the icon in the dotted line.

As illustrated in FIG. 16, the remote controller 401 may display the user interface, which is configured to indicate the button (B1) related to cooling only, and the button (B2)

related to cooling, differently from the button (B3) related to heating only, and the button (B4) related to heating, on the remote display 403.

According to the embodiment, the method in which the user interface indicates the icon and the button differently from each other according to the result of the process, is not limited to FIG. 16. Therefore, the method may be performed by using well-known methods, such as changing the size of the text.

As mentioned above, the operation mode of the branched port may be continuously updated according to a predetermined period. Accordingly, the user interface may be configured to indicate an icon and a button differently from each other by applying the result of the update of the operation mode for each the branched port. Therefore, the user interface, which is displayed on the remote display 403 by the remote controller 401, is not limited to FIG. 16, but the user interface may vary according to the result of the update of the operation mode of the branched port.

Table 2 simply summarizes a result of activation of the execution icon and button of the operation mode of the indoor apparatus based on the operation mode of the branched port.

TABLE 2

| Operation mode of branched port | Operation mode of indoor apparatus | | | | |
|---|---|---|---|---|---|
| | Automatic mode | Cooling mode | Dehumid-ification mode | Blowing mode | Heating mode |
| Cooling mode | Activation | Activation | Activation | Activation | Non-activation |
| Heating mode | Activation | Non-activation | Non-activation | Activation | Activation |
| non | Activation | Activation | Activation | Activation | Activation |

The remote controller 401 may generate at least one group by grouping the plurality of indoor apparatuses connected to the same branched port, by using the matching information. In addition, the remote controller 401 may perform the group control in the plurality of indoor apparatuses connected to the same branched port, by using the matching information. In this time, the remote controller 401 may generate a group in the plurality of indoor apparatuses connected to the same branched port, by using the matching information, or generate a group by setting of the manger, but is not limited thereto. The method for generating at least one group by grouping the plurality of indoor apparatuses may be implemented by data in the algorithm and program type, and then stored in the remote storage 407.

The remote controller 401 may display the user interface, which is configured to perform the group control in the plurality of indoor apparatuses 200 connected to the same branched port, and thus it may be possible to provide the convenience to the manager.

For example, the first, second, third, fourth, fifth and sixth indoor apparatus may be connected to the same branched port. Accordingly, as illustrated in FIG. 17, the remote controller 401 may set a first group by grouping the first, second, third, fourth, fifth and sixth indoor apparatus, and thus the remote controller 401 may display the user interface configured to simultaneously control the first group, on the remote display 403. Accordingly, as for the air conditioning apparatus 1 according to the embodiment, it may not be that the manager individually performs setting for each indoor apparatus among a large number of indoor apparatuses.

For example, the user interface may be configured to receive a control command for each group, and thus the manager may control the plurality of indoor apparatuses contained in the group, by inputting the control command once.

As is apparent from the above description, the air conditioning apparatus allows the indoor apparatus and the branched port to be easily interworked with each other.

The air conditioning apparatus prevents the mixing operation among the plurality of indoor apparatuses connected to the same branched port.

The air conditioning apparatus allows a user or a manger to more easily perform the group control in the plurality of indoor apparatuses.

The present disclosure will be described more fully hereinafter with reference to the accompanying drawings, in which exemplary embodiments of the present disclosure are shown. As those skilled in the art would realize, the described embodiments may be modified in various different ways, all without departing from the spirit or scope of the present disclosure Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

In the following description, terms such as "unit", "part", "block", "member", and "module" indicate a unit for processing at least one function or operation, wherein the unit and the block may be embodied as software or hardware, such as Field Programmable Gate Array (FPGA), Application Specific Integrated Circuit (ASIC), or embodied by combining hardware and software. However, the term "unit", "part", "block", "member", and "module" are not limited to software or hardware. Further, "unit", "part", "block", "member", and "module" may be constructed to exist in an addressable storage module, or to play one or more processors.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A central control apparatus of an air conditioning apparatus comprising:

a branched port comprising an inlet and a plurality of outlets connected to pipes of a plurality of indoor apparatuses and provided with predetermined identification information;

a central communicator configured to receive matching information between the branched port and the plurality of indoor apparatuses, which is set based on the predetermined identification information of the branched port; and a central controller configured to identify the plurality of indoor apparatuses connected to the branched port, based on the predetermined identification information of the branched port and the received matching information, and configured to control an operation of components contained in the plurality of indoor apparatuses based on a result of the identification.

2. The central control apparatus of the air conditioning apparatus of claim 1, wherein the central controller is further configured to update an operation mode of the branched port according to a predetermined period, based on state information of the indoor apparatuses connected to the branched port, and information about a predetermined operation mode of the branched port.

3. The central control apparatus of the air conditioning apparatus of claim 1, wherein:

the central communicator is configured to receive state information of the indoor apparatuses connected to the branched port, and the central controller is further configured to determine whether to stop an operation of at least one of the components of at least one of the indoor apparatuses by determining whether an error occurs and a level of the error based on the received state information of the indoor apparatuses.

4. The central control apparatus of the air conditioning apparatus of claim 1, wherein the central controller is further configured to:

determine whether a predetermined operation mode is present for the branched port; and determine whether any one of the plurality of indoor apparatuses is currently operating based on state information of the indoor apparatuses connected to the branched port, and information about the predetermined operation mode of the branched port.

5. The central control apparatus of the air conditioning apparatus of claim 4, wherein the central controller is further configured to:

determine that a current operation mode of the any one of the plurality of indoor apparatuses is the same as the predetermined operation mode of the branched port; and maintain the predetermined operation mode of the branched port.

* * * * *